US010012921B2

(12) United States Patent
Kamae et al.

(10) Patent No.: US 10,012,921 B2
(45) Date of Patent: Jul. 3, 2018

(54) TONER

(71) Applicant: CANON KABUSHIKI KAISHA, Tokyo (JP)

(72) Inventors: Kentaro Kamae, Kashiwa (JP); Ryuichiro Matsuo, Moriya (JP); Yosuke Iwasaki, Abiko (JP); Wakiko Katsumata, Kashiwa (JP); Kenta Mitsuiki, Toride (JP); Takeshi Ohtsu, Toride (JP); Masaharu Miura, Toride (JP); Koh Ishigami, Abiko (JP); Yuichi Mizo, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/681,742

(22) Filed: Aug. 21, 2017

(65) Prior Publication Data

US 2018/0059565 A1 Mar. 1, 2018

(30) Foreign Application Priority Data

Aug. 25, 2016 (JP) ..... 2016-164509

(51) Int. Cl.

| | |
|---|---|
| ***G03G 9/087*** | (2006.01) |
| ***G03G 9/08*** | (2006.01) |
| ***G03G 9/09*** | (2006.01) |
| ***G03G 9/097*** | (2006.01) |

(52) U.S. Cl.

CPC ..... *G03G 9/08755* (2013.01); *G03G 9/0821* (2013.01); *G03G 9/0827* (2013.01); *G03G 9/0904* (2013.01); *G03G 9/0918* (2013.01); *G03G 9/09733* (2013.01)

(58) Field of Classification Search

CPC ..... G03G 9/08755; G03G 9/08795; G03G 9/08797

See application file for complete search history.

(56) References Cited

U.S. PATENT DOCUMENTS

| | | | |
|---|---|---|---|
| 7,279,262 | B2 | 10/2007 | Fujikawa et al. |
| 7,288,348 | B2 | 10/2007 | Hayami et al. |
| 7,396,626 | B2 | 7/2008 | Fujikawa et al. |

(Continued)

FOREIGN PATENT DOCUMENTS

| | | | |
|---|---|---|---|
| JP | 2004-046095 | A | 2/2004 |
| JP | 2012063559 | A | 3/2012 |

*Primary Examiner* — Peter L Vajda

(74) *Attorney, Agent, or Firm* — Fitzpatrick Cella Harper and Scinto

(57) ABSTRACT

A toner having a toner particle containing an amorphous resin, a crystalline resin, a colorant, a release agent, and a polymer in which a styrene-acrylic polymer is graft-polymerized on a polyolefin, wherein the amorphous resin contains an amorphous polyester resin A, and the amorphous polyester resin A has a monomer unit derived from polyhydric alcohol and a monomer unit derived from polyhydric carboxylic acid, has, a particular amount of a succinic acid-derived monomer unit in the monomer unit derived from polyhydric carboxylic acid, and has, a particular amount of a monomer unit derived from a propylene oxide adduct on bisphenol A in the monomer unit derived from polyhydric alcohol; and has a particular softening point, a particular solubility parameter, and a particular peak molecular weight.

3 Claims, 1 Drawing Sheet

(56) References Cited

U.S. PATENT DOCUMENTS

| | | | |
|---|---|---|---|
| 7,396,629 | B2 | 7/2008 | Baba et al. |
| 7,611,813 | B2 | 11/2009 | Ida et al. |
| 7,629,100 | B2 | 12/2009 | Okamoto et al. |
| 7,858,283 | B2 | 12/2010 | Ishigami et al. |
| 7,939,233 | B2 | 3/2011 | Inoue et al. |
| 7,927,775 | B2 | 4/2011 | Komatsu et al. |
| 8,084,174 | B2 | 12/2011 | Hasegawa et al. |
| 8,114,562 | B2 | 2/2012 | Ishigami et al. |
| 8,137,886 | B2 | 3/2012 | Baba et al. |
| 8,288,069 | B2 | 10/2012 | Fujikawa et al. |
| 8,298,742 | B2 | 10/2012 | Okamoto et al. |
| 8,323,726 | B2 | 12/2012 | Naka et al. |
| 8,921,023 | B2 | 12/2014 | Baba et al. |
| 8,945,805 | B2 | 2/2015 | Baba et al. |
| 8,974,994 | B2 | 3/2015 | Kamae et al. |
| 8,986,914 | B2 | 3/2015 | Fujikawa et al. |
| 9,034,551 | B2 | 5/2015 | Endo et al. |
| 8,927,188 | B2 | 6/2015 | Naka et al. |
| 9,046,800 | B2 | 6/2015 | Hotta et al. |
| 9,058,924 | B2 | 6/2015 | Komatsu et al. |
| 9,063,443 | B2 | 6/2015 | Ishigami et al. |
| 9,075,328 | B2 | 7/2015 | Minagawa et al. |
| 9,152,088 | B1 | 10/2015 | Kobori et al. |
| 9,372,420 | B2 | 6/2016 | Mizo et al. |
| 9,417,540 | B2 | 8/2016 | Hashimoto et al. |
| 9,436,112 | B2 | 9/2016 | Iwasaki et al. |
| 9,665,021 | B2 | 5/2017 | Ohtsu et al. |
| 9,665,023 | B2 | 5/2017 | Kamae et al. |
| 9,665,026 | B2 | 5/2017 | Iwasaki et al. |
| 9,671,707 | B2 | 6/2017 | Minagawa et al. |
| 2010/0028796 | A1 | 2/2010 | Nakamura et al. |
| 2010/0183971 | A1 | 7/2010 | Fujikawa et al. |
| 2010/0189964 | A1* | 7/2010 | Kitagawa ..... G03G 9/0821 428/195.1 |
| 2012/0214097 | A1 | 8/2012 | Naka et al. |
| 2013/0244159 | A1 | 9/2013 | Ishigami et al. |
| 2013/0309603 | A1 | 11/2013 | Takahashi et al. |
| 2014/0134535 | A1 | 5/2014 | Baba et al. |
| 2014/0137428 | A1 | 5/2014 | Takenaka et al. |
| 2014/0329176 | A1 | 11/2014 | Kanno et al. |
| 2015/0037728 | A1* | 2/2015 | Moribe ..... G03G 9/08755 430/109.4 |
| 2016/0109820 | A1 | 4/2016 | Hashimoto et al. |
| 2016/0334725 | A1 | 11/2016 | Katsumata et al. |
| 2017/0058067 | A1 | 3/2017 | Ohtsu et al. |
| 2017/0242355 | A1 | 8/2017 | Ishigami et al. |

* cited by examiner

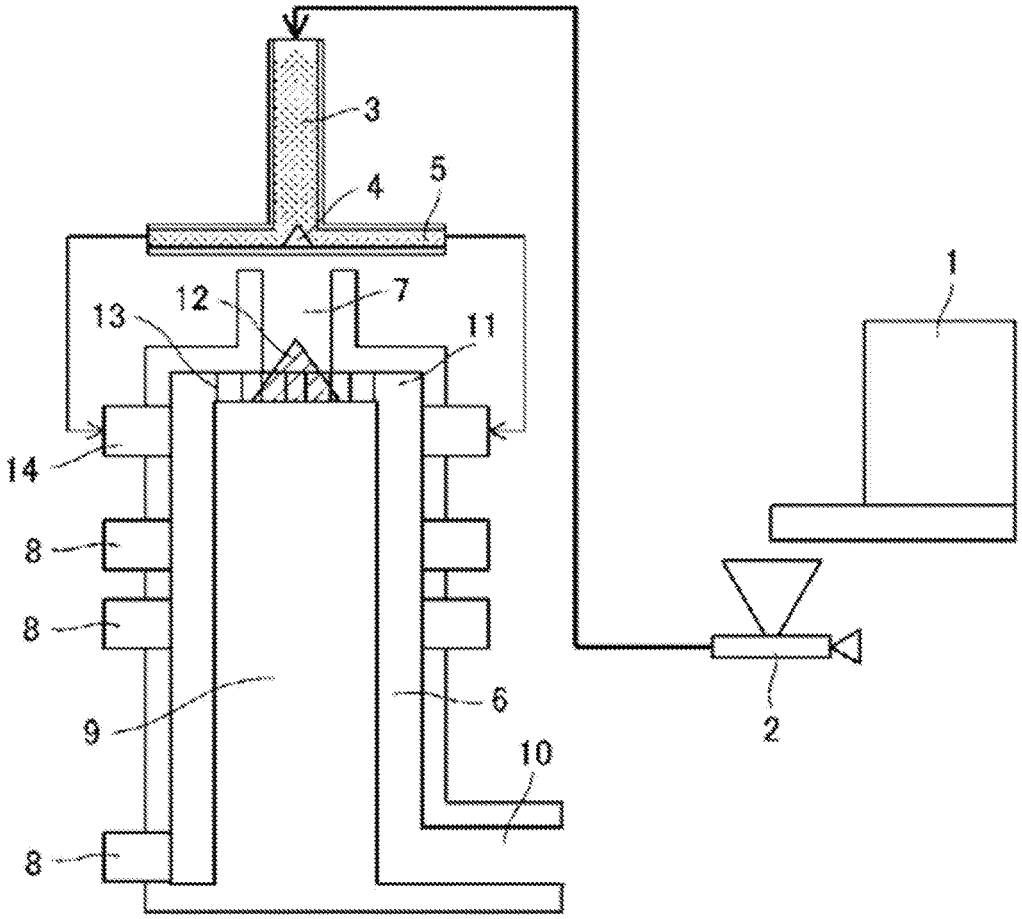
3
4
5
1
12
7
13
11
14
8
8
9
6
2
10
8

TONER

BACKGROUND OF THE INVENTION

Field of the Invention

The present invention relates to a toner used in, for example, electrophotographic systems, electrostatic recording systems, electrostatic printing systems, and toner jet systems.

Description of the Related Art

The widespread dissemination of electrophotographic system-based full-color copiers in recent years has also been accompanied by requirements for higher speeds, higher image qualities, and greater energy conservation. There is demand for toner that can undergo fixing at lower fixation temperatures as a specific energy conservation measure in order to lower the power consumption in the fixing step.

Thus, a toner that uses a crystalline polyester resin as a plasticizer for an amorphous polyester resin has been proposed in order to achieve low-temperature fixability (Japanese Patent Application Laid-open No. 2004-046095).

The amorphous polyester resin plasticized through the use of a crystalline polyester resin does exhibit a reduced viscosity and a certain effect on the low-temperature fixability is obtained.

In addition, the generation of additional effects on the low-temperature fixability has also been proposed through control of the SP value of the amorphous polyester resin and control of the SP value of the crystalline polyester resin (Japanese Patent Application Laid-open No. 2012-063559).

SUMMARY OF THE INVENTION

However, it is also true that the demands of recent years for higher speeds and greater energy savings can no longer be satisfied, insofar as the low-temperature fixability is concerned, simply by controlling the aforementioned SP values.

Moreover, due to the low electrical resistance of crystalline polyester resins, toner that uses a crystalline polyester resin has a tendency to readily exhibit a reduction in the quantity of toner charge in high-temperature, high-humidity environments.

The temperature control capabilities for the fixing unit have also been evolving in recent years in order to accommodate quick start-up (warm-up) from the power-saving mode, which is a user demand. In association with this, it has become difficult to generate the time for recovery of the toner charge quantity by stirring at the developing device, which has heretofore been carried out during the warm-up interval for the fixing unit. "Fogging"—which is a phenomenon in which the toner attaches to, and the density increases in, non-image areas which should properly be white regions—may occur when the toner charge quantity is low.

In view of the preceding, it is therefore an urgent matter to develop a toner that exhibits additional improvements in the low-temperature fixability and that is also resistant to reductions in the charge quantity even when subjected to long-term standing in a high-temperature, high-humidity environment.

The present invention provides a toner that solves the problems identified above. Specifically, the present invention provides a toner in which the low-temperature fixability coexists with the charge retention performance.

The present invention relates to a toner having a toner particle containing an amorphous resin, a crystalline resin, a colorant, a release agent, and a polymer in which a styrene-acrylic polymer is graft-polymerized on a polyolefin, wherein the amorphous resin contains an amorphous polyester resin A and the amorphous polyester resin A (1) has a monomer unit derived from polyhydric alcohol and a monomer unit derived from polyhydric carboxylic acid, has a content, in the monomer unit derived from polyhydric carboxylic acid, of at least 20.0 mol % and not more than 60.0 mol % of a succinic acid-derived monomer unit, and has a content, in the monomer unit derived from polyhydric alcohol, of at least 90.0 mol % and not more than 100.0 mol % of a monomer unit derived from a propylene oxide adduct on bisphenol A, (2) has a softening point of at least 85° C. and not more than 95° C., (3) has a solubility parameter [SP(A)], determined based on Fedors' equation, of at least 12.30 and not more than 12.40, and (4) has a peak molecular weight [Mp(A)] of at least 4,000 and not more than 5,000.

The present invention can thus provide a toner in which the low-temperature fixability coexists with the charge retention performance.

Further features of the present invention will become apparent from the following description of exemplary embodiments with reference to the attached drawings.

BRIEF DESCRIPTION OF THE DRAWINGS

The FIGURE is a schematic diagram of a heat-treatment apparatus.

DESCRIPTION OF THE EMBODIMENTS

Unless specifically indicated otherwise, expressions such as "at least XX and not more than YY" and "XX to YY" that show numerical value ranges refer in the present invention to numerical value ranges that include the lower limit and upper limit that are the end points.

The toner of the present invention is a toner that has a toner particle that contains an amorphous resin, a crystalline resin, a colorant, a release agent, and a polymer in which a styrene-acrylic polymer is graft-polymerized on a polyolefin, wherein the amorphous resin contains an amorphous polyester resin A and the amorphous polyester resin A (1) has a monomer unit derived from polyhydric alcohol and a monomer unit derived from polyhydric carboxylic acid, has a content, in the monomer unit derived from polyhydric carboxylic acid, of at least 20.0 mol % and not more than 60.0 mol % of a succinic acid-derived monomer unit, and has a content, in the monomer unit derived from polyhydric alcohol, of at least 90.0 mol % and not more than 100.0 mol % of a monomer unit derived from a propylene oxide adduct on bisphenol A, (2) has a softening point of at least 85° C. and not more than 95° C., (3) has a solubility parameter [SP(A)], determined based on Fedors' equation, of at least 12.30 and not more than 12.40, and (4) has a peak molecular weight [Mp(A)] of at least 4,000 and not more than 5,000.

As noted above, the demands of recent years for higher speeds and greater energy savings cannot be satisfied, insofar as the low-temperature fixability is concerned, just by controlling the SP values. For example, improvements in the low-temperature fixability were sought based on improving the compatibility by bringing the SP value of the amorphous polyester resin close to the SP value of the crystalline polyester resin.

However, the addition of long-chain aliphatic monomers such as adipic acid has heretofore been used as a means for lowering the SP value of amorphous polyester resins, but these monomers are known as soft monomers, and, in order to bring the thermal properties of the resin (glass transition temperature [Tg] and softening point [Tm]) to the target properties, the polymerization time had to be extended in order to raise the molecular weight. As a result, although the SP value was lowered, the molecular weight took on large values and due to this the expected plasticizing effect of the crystalline polyester resin was not obtained in some cases. Thus, the SP value and the molecular weight of the amorphous polyester resin resided in a trade-off relationship, and escaping from this trade-off relationship was an opportunity for improving the low-temperature fixability.

Thus, in order to escape from this trade-off relationship, the present inventors pursued investigations that considered the relationship between the thermal properties and the SP values of the monomers. As a result, it was discovered that succinic acid, while being an aliphatic monomer having a low SP value, acted like a hard monomer due to its short chain length and enabled a low SP value to be achieved without raising the molecular weight.

The present inventors carried out additional intensive investigations and discovered that, from the perspective of the low-temperature fixability, an appropriate range exists for the content of the succinic acid-derived monomer unit in the amorphous polyester resin.

Specifically, the amorphous resin constituting the toner particle contains an amorphous polyester resin A and this amorphous polyester resin A has a monomer unit derived from polyhydric alcohol and a monomer unit derived from polyhydric carboxylic acid and has a succinic acid-derived monomer unit content in the monomer unit derived from polyhydric carboxylic acid of at least 20.0 mol % and not more than 60.0 mol %. At least 30.0 mol % and not more than 50.0 mol % is preferred.

Here, monomer unit refers to the state of the reacted monomer substance in the polymer or resin.

When the content of the succinic acid-derived monomer unit is less than 20.0 mol %, the amorphous polyester resin assumes a high SP value and the plasticizing effect with reference to the crystalline resin is reduced and a good low-temperature fixability is not obtained.

When, on the other hand, the content of the succinic acid-derived monomer unit is larger than 60.0 mol %, the amorphous polyester resin assumes a large molecular weight and the plasticizing effect of the crystalline resin is reduced and a good low-temperature fixability is not obtained.

In addition, the electrical resistance of monomer units derived from aliphatic polycarboxylic acid tends to be lower than that of monomer units derived from aromatic polycarboxylic acid. Due to this, viewed in terms of the charge retention performance in high-temperature, high-humidity environments, the content of monomer unit derived from aliphatic polyhydric carboxylic acid in the polyhydric carboxylic acid-derived monomer unit is preferably at least 20.0 mol % and not more 60.0 mol % and is more preferably at least 30.0 mol % and not more than 50.0 mol %.

From the standpoint of the low-temperature fixability, the content of monomer unit derived from a propylene oxide adduct on bisphenol A, in the polyhydric alcohol-derived monomer unit in the amorphous polyester resin A, is at least 90.0 mol % and not more than 100.0 mol %. At least 95.0 mol % and not more than 100.0 mol % is preferred.

When the content of the monomer unit derived from a propylene oxide adduct on bisphenol A is less than 90.0 mol %, a large SP value occurs and the plasticizing effect of the crystalline resin is lowered and a good low-temperature fixability is not obtained.

From the standpoint of the coexistence of the low-temperature fixability with the storability, the softening point of the amorphous polyester resin A is at least 85° C. and not more than 95° C. and is preferably at least 88° C. and not more than 92° C.

When this softening point is less than 85° C., the molecular weight of the amorphous polyester resin A is reduced and the glass transition temperature (Tg) also assumes a low value and the storability of the toner in high-temperature, high-humidity environments is then reduced. When, on the other hand, the softening point is larger than 95° C., the amorphous polyester resin A assumes a high molecular weight and the plasticizing effect of the crystalline resin is reduced and an excellent low-temperature fixability is not obtained.

Adjusting the polymerization time during production of the amorphous resin is an example of a technique for adjusting the softening point into the indicated range.

From the standpoint of the low-temperature fixability, the amorphous polyester resin A has a solubility parameter [SP(A)], as determined based on Fedors' equation, of at least 12.30 and not more than 12.40 and preferably at least 12.32 and not more than 12.37.

When the solubility parameter [SP(A)] is less than 12.30, the compatibility between the amorphous polyester resin A and the crystalline resin is too high and it is difficult for recrystallization of the crystalline resin to occur in high-temperature, high-humidity environments and the toner storability is reduced.

When, on the other hand, the solubility parameter [SP(A)] is larger than 12.40, the compatibility between the amorphous polyester resin and crystalline resin is low and the plasticizing effect of the crystalline resin is reduced and an excellent low-temperature fixability is not obtained.

Adjusting the contents of the monomer units that are constituent components of the amorphous polyester resin is an example of a technique for adjusting the solubility parameter [SP(A)] into the indicated range.

From the standpoint of the coexistence of the low-temperature fixability with the storability, the amorphous polyester resin A has a peak molecular weight [Mp(A)] of at least 4,000 and not more than 5,000 and preferably at least 4,300 and not more than 4,700.

When the peak molecular weight [Mp(A)] is less than 4,000, the molecular weight is then low and due to this the glass transition temperature also assumes low values and the toner storability in high-temperature, high-humidity environments is reduced.

When, on the other hand, the peak molecular weight [Mp(A)] is larger than 5,000, the molecular weight is then high and the plasticizing effect of the crystalline resin is reduced and a good low-temperature fixability is not obtained.

Techniques for adjusting the peak molecular weight [Mp (A)] into the indicated range can be exemplified by adjusting the contents of the monomer units that are the constituent components of the amorphous polyester resin and adjusting the polymerization time during production of the amorphous polyester resin.

From the standpoints of the low-temperature fixability and the storability, the glass transition temperature (Tg) of the amorphous polyester resin A is preferably at least 45° C. and not more than 70° C.

The amorphous resin contains amorphous polyester resin as its main component. Here, main component means that the content of the amorphous polyester resin in the amorphous resin is at least 50 mass %. The amorphous polyester resin contains an alcohol-derived monomer unit and a carboxylic acid-derived monomer unit.

In addition, the amorphous resin contains an amorphous polyester resin A. The content of the amorphous polyester resin A in the amorphous resin is preferably at least 50 mass % and not more than 90 mass % and is more preferably at least 60 mass % and not more than 80 mass %.

The alcohol here can be exemplified by dihydric polyhydric alcohols, trihydric and higher hydric polyhydric alcohols, and their derivatives.

The carboxylic acid here can be exemplified by dibasic polyhydric carboxylic acids, tribasic and higher basic polyhydric carboxylic acids, and their derivatives.

The derivatives should provide the same monomer unit structure by condensation polymerization, but are not otherwise particularly limited. The derivatives can be exemplified by esterified diol derivatives, carboxylic acid anhydrides, alkyl esters of carboxylic acids, and acid chlorides.

The dihydric alcohols can be exemplified by the following:

ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenols with the following formula (I) and derivatives thereof, and diols with the following formula (II).

[C1]

(I)

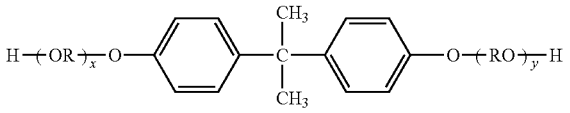

(In the formula, R is an ethylene group or propylene group; x and y are each integers equal to or greater than 1; and the average value of x+y is at least 2 and not more than 10.)

[C2]

(II)

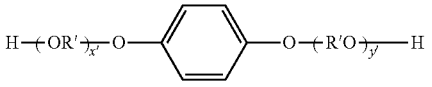

(In the formula, R' is

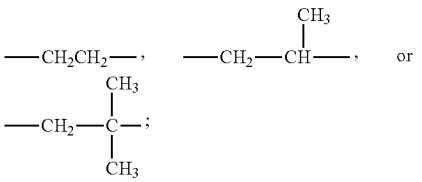

x' and y' are each integers equal to or greater than 0; and the average value of x'+y' is at least 0 and not more than 10.)

The trihydric and higher hydric alcohols can be exemplified by the following:

sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Among the preceding, the use is preferred of glycerol, trimethylolpropane, and pentaerythritol.

A single dihydric alcohol may be used or a plurality may be used in combination, and a single trihydric or higher hydric alcohol may be used or a plurality may be used in combination.

The dibasic carboxylic acids can be exemplified by the following:

maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, isododecenylsuccinic acid, n-dodecylsuccinic acid, isododecylsuccinic acid, n-octenylsuccinic acid, n-octylsuccinic acid, isooctenylsuccinic acid, isooctylsuccinic acid, and the anhydrides and lower alkyl esters of the preceding.

Among the preceding, the use is preferred of maleic acid, fumaric acid, terephthalic acid, succinic acid, and n-dodecenylsuccinic acid.

The tribasic and higher basic carboxylic acids can be exemplified by the following:

1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxy-2-methyl-2-methylenecarboxypropane, 1,2,4-cyclohexanetricarboxylic acid, tetra(methylenecarboxy) methane, 1,2,7,8-octanetetracarboxylic acid, pyromellitic acid, Empol trimer acid, and the anhydrides and lower alkyl esters of the preceding.

Among the preceding, the use of 1,2,4-benzenetricarboxylic acid, i.e., trimellitic acid, and derivatives thereof is preferred because they are inexpensive and provide facile reaction control.

A single dibasic carboxylic acid may be used or a plurality may be used in combination, and a single tribasic or higher basic carboxylic acid may be used or a plurality may be used in combination.

There are no particular limitations on the method of producing the amorphous polyester resin, and known methods can be used. For example, polyester resin may be produced by simultaneously introducing the aforementioned alcohol and carboxylic acid and carrying out a polymerization through an esterification reaction or transesterification reaction and a condensation reaction.

There are also no particular limitations on the polymerization temperature, but the range of at least 180° C. and not more than 290° C. is preferred. A polymerization catalyst, for example, a titanium catalyst, tin catalyst, zinc acetate, antimony trioxide, germanium dioxide, and so forth, can be used in the polyester polymerization.

The amorphous resin may contain an additional resin component as long as the amorphous polyester resin is the main component.

This additional resin component can be exemplified by hybrid resins between an amorphous polyester resin and a vinyl resin. In a preferred method for obtaining a reaction product between a vinyl resin and an amorphous polyester resin as such a hybrid resin, a polymerization reaction for either resin or both resins is carried out in the presence of a polymer that contains a monomer component that can react with each of the vinyl resin and amorphous polyester resin.

For example, among monomers that can constitute amorphous polyester resins, monomer that can react with vinyl resin can be exemplified by unsaturated dicarboxylic acids such as phthalic acid, maleic acid, citraconic acid, and itaconic acid and their anhydrides.

Among monomers that can constitute vinyl resins, monomer that can react with amorphous polyester resin can be exemplified by monomer that contains a carboxy group or hydroxy group and by acrylate esters and methacrylate esters.

As long as the main component is amorphous polyester resin, various resins heretofore known as amorphous resins other than the aforementioned vinyl resin can be co-used in the amorphous resin.

These resins can be exemplified by phenolic resins, natural resin-modified phenolic resins, natural resin-modified maleic acid resins, acrylic resins, methacrylic resins, polyvinyl acetate resins, silicone resins, polyurethane, polyamide resins, furan resins, epoxy resins, xylene resins, polyvinyl butyral, terpene resins, coumarone-indene resins, and petroleum resins.

From the standpoint of the charge retention performance in high-temperature, high-humidity environments, the acid value of the amorphous polyester resin A is preferably at least 5 mg KOH/g and not more than 20 mg KOH/g.

From the standpoints of the low-temperature fixability and the storability, the hydroxyl value of the amorphous polyester resin A is preferably at least 20 mg KOH/g and not more than 70 mg KOH/g.

In addition, an amorphous resin may be used as provided by the mixture of a high molecular weight amorphous polyester resin B in addition to the low molecular weight amorphous polyester resin A.

Viewed from the standpoints of the low-temperature fixability and the hot offset resistance, the content ratio (A/B) between the previously described low molecular weight amorphous polyester resin A and the high molecular weight amorphous polyester resin B is preferably 50/50 to 85/15 on a mass basis.

Viewed from the standpoint of the hot offset resistance, the peak molecular weight of the amorphous polyester resin B is preferably at least 8,000 and not more than 20,000.

The acid value of the amorphous polyester resin B is preferably at least 15 mg KOH/g and not more than 30 mg KOH/g from the standpoint of the charge retention performance in high-temperature, high-humidity environments.

The crystalline resin constituting the toner particle preferably contains a crystalline polyester resin as its main component. Here, main component means that the content of the crystalline polyester resin in the crystalline resin is at least 50 mass %.

The crystalline polyester resin contains an alcohol-derived monomer unit and a carboxylic acid-derived monomer unit. In addition, the crystalline polyester resin preferably contains a monomer unit derived from an aliphatic diol having at least 2 and not more than 22 carbons and a monomer unit derived from an aliphatic dicarboxylic acid having at least 2 and not more than 22 carbons. A crystalline resin is a resin that presents an endothermic peak in differential scanning calorimetric measurement (DSC).

In addition, the crystalline resin preferably contains a crystalline polyester resin C. The content of the crystalline polyester resin C in the crystalline resin is preferably at least 50 mass % and not more than 100 mass % and is more preferably at least 60 mass % and not more than 100 mass %.

From the standpoints of the low-temperature fixability and the storability, the crystalline polyester resin C has a solubility parameter [SP(C)], as determined based on Fedors' equation, preferably of at least 11.00 and not more than 11.40 and more preferably at least 11.10 and not more than 11.35.

Adjusting the contents of the monomer units that are the constituent components of the crystalline polyester resin is an example of a technique for adjusting the solubility parameter [SP(C)] into the indicated range.

When the solubility parameter [SP(C)] is in the indicated range, the compatibility with the amorphous polyester resin A is controlled and recrystallization of the crystalline polyester resin C in high-temperature, high-humidity environments then coexists with the plasticizing effect by the crystalline polyester resin C.

By using the crystalline polyester resin C, the crystalline polyester resin C compatibilizes with the amorphous polyester resin A and the spacing between the molecular chains of the amorphous resin are widened and the intermolecular forces are then weakened. As a result, the glass transition temperature (Tg) of the amorphous resin is substantially lowered and a state is assumed in which the melt viscosity is low and the low-temperature fixability is then improved.

That is, an improving trend in the low-temperature fixability of the toner is set up by raising the compatibility of the crystalline polyester resin C with the amorphous polyester resin A.

In order to raise the compatibility of the crystalline polyester resin C with the amorphous polyester resin A, the [SP(C)] is increased by raising the ester group concentration by shortening the number of carbons in the aliphatic diol and/or aliphatic dicarboxylic acid of the monomer units constituting the crystalline polyester resin C.

On the other hand, for toner that has a substantially reduced glass transition temperature, it is also necessary to secure the storability during, for example, transport and/or use in high-temperature, high-humidity environments. Due to this, when the toner is exposed to such an environment, this should cause recrystallization of the crystalline polyester resin C in the compatibilized toner to return the glass transition temperature of the toner to the glass transition temperature of the amorphous resin.

Here, when the crystalline polyester resin C has a high ester group concentration and the compatibility between the amorphous polyester resin A and the crystalline polyester resin C is too high, recrystallization of the crystalline polyester resin C is then impeded.

Due to this, in order to bring about recrystallization of the crystalline polyester resin C in the compatibilized toner, the number of carbons in the aliphatic diol and/or aliphatic dicarboxylic acid that are the monomer units constituting the crystalline polyester resin C is extended and the ester group concentration is then lowered and [SP(C)] is decreased.

Considering the preceding, for example, in order to enable the low-temperature fixability to coexist with the storability, the crystalline polyester resin C preferably has a monomer unit derived from aliphatic diol having at least 6 and not more than 12 carbons and a monomer unit derived from aliphatic dicarboxylic acid having at least 6 and not more than 12 carbons and preferably has a solubility parameter [SP(C)], as determined based on Fedors' equation, of at least 11.00 and not more than 11.40.

In addition, the weight-average molecular weight (Mw) of crystalline polyester resin C is preferably at least 9,000 and not more than 12,000.

There are no particular limitations on the aliphatic diol having at least 2 and not more than 22 carbons (preferably at least 6 and not more than 12 carbons), but chain (more preferably linear) aliphatic diols are preferred. The following are specific examples:

ethylene glycol, diethylene glycol, triethylene glycol, 1,2-propanediol, 1,3-propanediol, dipropylene glycol, 1,4-butanediol, 1,4-butadiene glycol, 1,5-pentanediol, neopentyl glycol, 1,6-hexanediol, 1,7-heptanediol, 1,8-octanediol, 1,9-nonanediol, 1,10-decanediol, 1,11-undecanediol, and 1,12-dodecanediol.

Preferred examples among the preceding are linear aliphatic α,ω-diols such as 1,6-hexanediol, 1,7-heptanediol, 1,8-octanediol, 1,9-nonanediol, 1,10-decanediol, 1,11-undecanediol, and 1,12-dodecanediol.

Derivatives of these diols may be used as long as the derivative provides the same monomer unit structure by condensation polymerization. These derivatives can be exemplified by esterified diols.

Moreover, the content of monomer units derived from at least one compound selected from the group consisting of aliphatic diols having at least 2 and not more than 22 carbons (more preferably at least 6 and not more than 12 carbons) and their derivatives, in the total alcohol component-derived monomer units constituting the crystalline polyester resin, is preferably at least 50 mass % and not more than 100 mass % and is more preferably at least 70 mass % and not more than 100 mass %.

A polyhydric alcohol may also be used in addition to the aliphatic diol described above.

Among the polyhydric alcohols, diols other than the aforementioned aliphatic diols can be exemplified by aromatic alcohols such as polyoxyethylenated bisphenol A and polyoxypropylenated bisphenol A and by 1,4-cyclohexanedimethanol.

Among the polyhydric alcohols, the at least trihydric polyhydric alcohols can be exemplified by aromatic alcohols such as 1,3,5-trihydroxymethylbenzene and aliphatic alcohols such as pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, and trimethylolpropane.

A monohydric alcohol may also be used to the extent that the properties of the crystalline polyester resin are not lost. This monohydric alcohol can be exemplified by monoalcohols such as n-butanol, isobutanol, sec-butanol, n-hexanol, n-octanol, 2-ethylhexanol, cyclohexanol, and benzyl alcohol.

There are no particular limitations, on the other hand, on the aliphatic dicarboxylic acid having at least 2 and not more than 22 carbons (more preferably at least 6 and not more than 12 carbons), but chain (more preferably linear) aliphatic dicarboxylic acids are preferred. The following are specific examples:

oxalic acid, malonic acid, succinic acid, glutaric acid, adipic acid, pimelic acid, suberic acid, glutaconic acid, azelaic acid, sebacic acid, nonanedicarboxylic acid, decanedicarboxylic acid, undecanedicarboxylic acid, dodecanedicarboxylic acid, maleic acid, fumaric acid, mesaconic acid, citraconic acid, and itaconic acid.

The dicarboxylic acid derivatives cited above may be used as long as they provide the same monomer unit structure by condensation polymerization. Examples are the anhydrides of dicarboxylic acids, alkyl esters of dicarboxylic acids, and acid chlorides.

Moreover, the content of monomer units derived from at least one compound selected from the group consisting of aliphatic dicarboxylic acids having at least 2 and not more than 22 carbons (more preferably at least 6 and not more than 12 carbons) and their derivatives, in the total carboxylic acid component-derived monomer units constituting the crystalline polyester resin, is preferably at least 50 mass % and not more than 100 mass % and is more preferably at least 70 mass % and not more than 100 mass %.

A polyhydric carboxylic acid may also be used in addition to the aliphatic dicarboxylic acid described above.

Among the polyhydric carboxylic acids, dibasic carboxylic acids other than the aforementioned aliphatic dicarboxylic acids can be exemplified by aromatic carboxylic acids such as isophthalic acid and terephthalic acid, aliphatic carboxylic acids such as n-dodecylsuccinic acid and n-dodecenylsuccinic acid, and alicyclic carboxylic acids such as cyclohexanedicarboxylic acid, wherein derivatives of the preceding such as the anhydrides and lower alkyl esters are also included here.

Among the polyhydric carboxylic acids, at least tribasic polyhydric carboxylic acids can be exemplified by aromatic carboxylic acids such as 1,2,4-benzenetricarboxylic acid (trimellitic acid), 2,5,7-naphthalenetricarboxylic acid, 1,2,4-naphthalenetricarboxylic acid, and pyromellitic acid, and by aliphatic carboxylic acids such as 1,2,4-butanetricarboxylic acid, 1,2,5-hexanetricarboxylic acid, and 1,3-dicarboxy-2-methyl-2-methylenecarboxypropane, wherein derivatives of the preceding such as the anhydrides and lower alkyl esters are also included here.

A monobasic carboxylic acid may also be used to the extent that the properties of the crystalline polyester resin are not lost. This monobasic carboxylic acid can be exemplified by benzoic acid, naphthalenecarboxylic acid, salicylic acid, 4-methylbenzoic acid, 3-methylbenzoic acid, phenoxyacetic acid, biphenylcarboxylic acid, acetic acid, propionic acid, butyric acid, and octanoic acid.

Viewed from the standpoints of the charging performance in high-temperature, high-humidity environments and the low-temperature fixability, the content of the crystalline polyester resin per 100 mass parts of the amorphous resin is preferably at least 1.0 mass parts and not more than 20.0 mass parts and is more preferably at least 3.0 mass parts and not more than 10.0 mass parts.

From the standpoints of the low-temperature fixability and the storability, the crystalline polyester resin may have, in molecular chain terminal position, a monomer unit derived from one or more aliphatic compounds (also referred to herebelow as a nucleating agent) selected from the group consisting of aliphatic monocarboxylic acids and aliphatic monoalcohols that have at least 10 and not more than 20 carbons.

With regard to the crystalline component of the crystalline polyester resin, generally crystal nuclei are formed followed by crystal growth. By placing the aforementioned nucleating agent segment in molecular chain terminal position in the crystalline polyester resin, this becomes a crystal nucleus and recrystallization can then be accelerated and the storability is improved as a consequence.

When the number of carbons is in the indicated range, condensation in molecular chain terminal position is also easily brought about and the free monomer is then not present, making this preferred from the standpoint of the storability.

There is also no loss of the compatibility between the crystalline polyester resin and the amorphous polyester resin when the number of carbons is in the indicated range, making this preferred also from the standpoint of the low-temperature fixability.

The content of monomer unit derived from this aliphatic compound, with reference to the total monomer units constituting the crystalline polyester resin, is preferably at least 1.0 mol % and not more than 10.0 mol % and is more preferably at least 4.0 mol % and not more than 8.0 mol %. The content of the aliphatic compound-derived monomer unit is preferably in the indicated range because a suitable amount of nucleating agent is then caused to be present without impairing the low-temperature fixability.

The aliphatic monocarboxylic acid having at least 10 and not more than 20 carbons can be exemplified by capric acid (decanoic acid), undecanoic acid, lauric acid (dodecanoic acid), tridecanoic acid, myristic acid (tetradecanoic acid), pentadecanoic acid, palmitic acid (hexadecanoic acid), margaric acid (heptadecanoic acid), stearic acid (octadecanoic acid), nonadecanoic acid, and arachidic acid (eicosanoic acid).

The aliphatic monoalcohol having at least 10 and not more than 20 carbon atoms can be exemplified by capric alcohol (decanol), undecanol, lauryl alcohol (dodecanol), tridecanol, myristyl alcohol (tetradecanol), pentadecanol, palmityl alcohol (hexadecanol), margaryl alcohol (heptadecanol), stearyl alcohol (octadecanol), nonadecanol, and arachidyl alcohol (eicosanol).

The crystalline polyester resin can be produced using common methods of polyester synthesis. For example, the crystalline polyester resin can be obtained by carrying out an esterification reaction or transesterification reaction between the above-described carboxylic acid and alcohol followed by reducing the pressure or introducing nitrogen gas and carrying out a polycondensation reaction according to a common method. In addition, the aforementioned aliphatic compound may be added to the resulting crystalline polyester resin and an esterification reaction may then be run to provide a crystalline polyester resin having the aliphatic compound in molecular chain terminal position.

The aforementioned esterification reaction or transesterification reaction may as necessary be carried out using a common esterification catalyst or transesterification catalyst, e.g., sulfuric acid, titanium butoxide, dibutyltin oxide, tin 2-ethylhexanoate, manganese acetate, and magnesium acetate.

The polycondensation reaction can be carried out using a known catalyst, e.g., a common polymerization catalyst, for example, titanium butoxide, dibutyltin oxide, tin 2-ethylhexanoate, tin acetate, zinc acetate, tin disulfide, antimony trioxide, and germanium dioxide. The polymerization temperature and amount of catalyst are not particularly limited and may be determined as appropriate.

In order to raise the strength of the resulting crystalline polyester resin, a method may be used in the esterification reaction, transesterification reaction, or polycondensation reaction such as, e.g., charging all the monomer all at once, or first reacting the divalent monomer in order to bring the low molecular weight component to low levels and thereafter adding the trivalent and higher valent monomer and reacting.

[SP(A)] and [SP(C)] preferably satisfy the relationship $0.80 \leq \{SP(A)-SP(C)\} \leq 1.30$ and more preferably satisfy the relationship $0.90 \leq \{SP(A)-SP(C)\} \leq 1.20$.

The difference between [SP(A)] and [SP(C)] should be considered when considering control of the state of compatibility between the amorphous polyester resin and crystalline polyester resin in the toner. By satisfying the indicated relationship, the low-temperature fixability provided by the promotion of plasticization and the storability provided by the promotion of crystallization can be effectively exhibited.

The toner particle contains a polymer (also referred to below simply as the "graft polymer") in which styrene-acrylic polymer is graft-polymerized on polyolefin.

Viewed from the standpoints of the storability and charge retention performance, the styrene-acrylic polymer preferably has a monomer unit derived from a cycloalkyl (meth) acrylate. Here, cycloalkyl (meth)acrylate denotes a cycloalkyl acrylate or a cycloalkyl methacrylate.

The hydrophobicity of the toner is increased by the incorporation of this graft polymer, and due to this the amount of moisture adsorption in high-temperature, high-humidity environments is reduced and reductions in the glass transition temperature of the toner particle and discharge of the charge from the toner particle can be inhibited.

The content of the graft polymer is preferably at least 3.0 mass parts and not more than 10.0 mass parts per 100 mass parts of the amorphous resin.

When the content of the graft polymer is in the indicated range, the hydrophobicity of the graft polymer is also expressed by the toner and the charge retention performance is further improved due to the reduction in the amount of moisture adsorption in high-temperature, high-humidity environments.

In addition, the ability to generate a fine dispersion of the crystalline polyester resin in the amorphous resin is improved by this graft polymer and the low-temperature fixability is then improved.

There are no particular limitations on the polyolefin as long as it is a polymer or copolymer of an unsaturated hydrocarbon that has a single double bond, and a variety of polyolefins can be used. For example, a low molecular weight polyethylene compound and a low molecular weight polypropylene compound are preferred.

This polyolefin preferably has a peak temperature for the maximum endothermic peak measured using a differential scanning calorimeter (DSC) of approximately at least 70° C. and not more than 90° C.

The content of the monomer unit originating from the polyolefin in the overall monomer units constituting the graft polymer is preferably at least 1.0 mol % and not more than 15.0 mol % and is more preferably at least 2.0 mol % and not more than 10.0 mol %.

The cycloalkyl (meth)acrylate-derived monomer unit can be represented by the following formula (1).

[C3]

formula (1)

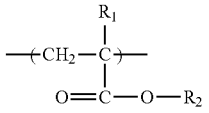

[In formula (1), $R_1$ represents the hydrogen atom or a methyl group and $R_2$ represents a cycloalkyl group.]

$R_2$ is preferably a cycloalkyl group having at least 3 and not more than 18 carbons and is more preferably a cycloalkyl group having at least 4 and not more than 12 carbons.

Specific examples of this cycloalkyl group are the cyclopropyl group, cyclobutyl group, cyclopentyl group, cyclohexyl group, t-butylcyclohexyl group, cycloheptyl group, and cyclooctyl group.

The cycloalkyl group may also have, for example, an alkyl group, halogen atom, carboxy group, carbonyl group, hydroxy group, and so forth, as a substituent. The alkyl group here is preferably an alkyl group having 1 to 4 carbons.

The position and number of substituents may be freely selected, and, when two or more substituents are present, these substituents may be the same or may differ.

The following are specific examples of the cycloalkyl (meth)acrylate: cyclopropyl acrylate, cyclobutyl acrylate, cyclopentyl acrylate, cyclohexyl acrylate, cycloheptyl acrylate, cyclooctyl acrylate, cyclopropyl methacrylate, cyclobutyl methacrylate, cyclopentyl methacrylate, cyclohexyl methacrylate, cycloheptyl methacrylate, cyclooctyl methacrylate, dihydrocyclopentadienyl acrylate, dicyclopentanyl acrylate, and dicyclopentanyl methacrylate.

Among the preceding, cyclohexyl acrylate, cycloheptyl acrylate, cyclooctyl acrylate, cyclohexyl methacrylate, cycloheptyl methacrylate, and cyclooctyl methacrylate are preferred from the standpoint of the hydrophobicity.

The content of the cycloalkyl (meth)acrylate-derived monomer unit in the overall monomer units constituting the graft polymer is preferably at least 1.0 mol % and not more than 40.0 mol % and is more preferably at least 3.0 mol % and not more than 15.0 mol %.

Monomer that is a constituent component of the styrene-acrylic polymer other than the aforementioned cycloalkyl (meth)acrylate can be exemplified by the following:

styrenic monomer such as styrene, α-methylstyrene, p-methylstyrene, m-methylstyrene, p-methoxystyrene, p-hydroxystyrene, p-acetoxystyrene, vinyltoluene, ethylstyrene, phenylstyrene, and benzylstyrene; alkyl esters (wherein the number of carbons in the alkyl is at least 1 and not more than 18) of unsaturated carboxylic acids, e.g., methyl acrylate, ethyl acrylate, butyl acrylate, pentyl acrylate, hexyl acrylate, heptyl acrylate, 2-ethylhexyl acrylate, methyl methacrylate, ethyl methacrylate, butyl methacrylate, pentyl methacrylate, hexyl methacrylate, heptyl methacrylate, and 2-ethylhexyl methacrylate; vinyl ester monomers such as vinyl acetate; vinyl ether monomers such as vinyl methyl ether; vinyl monomers that contain a halogen element, such as vinyl chloride; and diene monomers such as butadiene and isobutylene. A single one of these may be used or two or more may be used in combination.

The content of the styrenic monomer-derived monomer unit, in the total monomer units constituting the graft polymer, is preferably at least 60.0 mol % and not more than 90.0 mol % and is more preferably at least 70.0 mol % and not more than 85.0 mol %.

The content of monomer unit derived from an alkyl ester of an unsaturated carboxylic acid, in the total monomer units constituting the graft polymer, is preferably at least 5.0 mol % and not more than 30.0 mol % and is more preferably at least 8.0 mol % and not more than 15.0 mol %.

The peak molecular weight of the graft polymer is preferably at least 5,000 and not more than 80,000 and is more preferably at least 6,000 and not more than 70,000.

The softening point of the graft polymer is preferably at least 100° C. and not more than 150° C. and is more preferably at least 110° C. and not more than 135° C.

The method for carrying out the graft polymerization of the styrene-acrylic polymer on the polyolefin is not particularly limited, and heretofore known methods can be used.

The toner particle contains a release agent. This release agent can be exemplified by the following:

hydrocarbon waxes such as low molecular weight polyethylene, low molecular weight polypropylene, alkylene copolymers, microcrystalline wax, paraffin wax, and Fischer-Tropsch waxes; oxides of hydrocarbon waxes, such as oxidized polyethylene wax, and their block copolymers; waxes in which the major component is fatty acid ester, such as carnauba wax; and waxes provided by the partial or complete deacidification of fatty acid esters, such as deacidified carnauba wax. Additional examples are as follows: saturated straight-chain fatty acids such as palmitic acid, stearic acid, and montanic acid; unsaturated fatty acids such as brassidic acid, eleostearic acid, and parinaric acid; saturated alcohols such as stearyl alcohol, aralkyl alcohols, behenyl alcohol, carnaubyl alcohol, ceryl alcohol, and melissyl alcohol; polyhydric alcohols such as sorbitol; esters between a fatty acid, e.g., palmitic acid, stearic acid, behenic acid, montanic acid, and so forth, and an alcohol such as stearyl alcohol, aralkyl alcohols, behenyl alcohol, carnaubyl alcohol, ceryl alcohol, melissyl alcohol, and so forth; fatty acid amides such as linoleamide, oleamide, and lauramide; saturated fatty acid bisamides such as methylenebisstearamide, ethylenebiscapramide, ethylenebislauramide, and hexamethylenebisstearamide; unsaturated fatty acid amides such as ethylenebisoleamide, hexamethylenebisoleamide, N,N'-dioleyladipamide, and N,N'-dioleylsebacamide; aromatic bisamides such as m-xylenebisstearamide and N,N'-distearylisophthalamide; fatty acid metal salts (generally known as metal soaps) such as calcium stearate, calcium laurate, zinc stearate, and magnesium stearate; partial esters between a polyhydric alcohol and a fatty acid, such as behenic monoglyceride; and hydroxy group-containing methyl ester compounds obtained by the hydrogenation of plant oils.

Among these waxes, the following are preferred from the standpoint of improving the low-temperature fixability and the storability: hydrocarbon waxes such as paraffin waxes and Fischer-Tropsch waxes, and fatty acid ester waxes such as carnauba wax. Hydrocarbon waxes are more preferred.

The content of the release agent is preferably at least 3.0 mass parts and not more than 8.0 mass parts per 100 mass parts of the amorphous resin.

In addition, the peak temperature (melting point) of the maximum endothermic peak of the release agent, in the endothermic curve during temperature ramp up as measured using a differential scanning calorimeter, is preferably at least 45° C. and not more than 140° C.

The peak temperature of the maximum endothermic peak for the release agent is preferably in the indicated range because this enables the storability of the toner to coexist with its hot offset resistance.

The toner particle contains a colorant. This colorant can be exemplified as follows.

The black colorants can be exemplified by carbon black and by black colorants obtained by color mixing using a yellow colorant, magenta colorant, and cyan colorant to give a black color. A pigment may be used by itself for the colorant, but the enhanced sharpness provided by the co-use of a dye with a pigment is more preferred from the standpoint of the image quality of full-color images.

Pigments for magenta toners can be exemplified by C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269, and 282; C.I. Pigment Violet 19; and C.I. Vat Red 1, 2, 10, 13, 15, 23, 29, and 35.

Dyes for magenta toners can be exemplified by oil-soluble dyes such as C.I. Solvent Red 1, 3, 8, 23, 24, 25, 27, 30, 49, 81, 82, 83, 84, 100, 109, and 121; C.I. Disperse Red 9; C.I. Solvent Violet 8, 13, 14, 21, and 27; and C.I. Disperse Violet 1, and basic dyes such as C.I. Basic Red 1, 2, 9, 12, 13, 14, 15, 17, 18, 22, 23, 24, 27, 29, 32, 34, 35, 36, 37, 38, 39, and 40 and C.I. Basic Violet 1, 3, 7, 10, 14, 15, 21, 25, 26, 27, and 28.

Pigments for cyan toners can be exemplified by C.I. Pigment Blue 2, 3, 15:2, 15:3, 15:4, 16, and 17; C.I. Vat Blue 6; C.I. Acid Blue 45; and copper phthalocyanine pigments having 1 to 5 phthalimidomethyl groups substituted on the phthalocyanine skeleton.

C.I. Solvent Blue 70 is an example of a dye for cyan toners.

Pigments for yellow toners can be exemplified by C.I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, and 185 and by C.I. Vat Yellow 1, 3, and 20.

C.I. Solvent Yellow 162 is an example of a dye for yellow toners.

The colorant content is preferably at least 0.1 mass parts and not more than 30.0 mass parts per 100 mass parts of the amorphous resin.

The toner may as necessary also contain a charge control agent. Known charge control agents can be used as the charge control agent incorporated in the toner, but metal compounds of aromatic carboxylic acids that are colorless, support a rapid toner charging speed, and enable the stable maintenance of a certain charge quantity are particularly preferred.

Negative-charging charge control agents can be exemplified by metal salicylate compounds, metal naphthoate compounds, metal dicarboxylate compounds, polymer compounds having sulfonic acid or carboxylic acid in side chain position, polymer compounds having sulfonate salt or sulfonate ester in side chain position, polymer compounds having carboxylate salt or carboxylate ester in side chain position, boron compounds, urea compounds, silicon compounds, and calixarene.

Positive-charging charge control agents can be exemplified by quaternary ammonium salts, polymer compounds having such quaternary ammonium salts in side chain position, guanidine compounds, and imidazole compounds.

The charge control agent may be internally added or externally added to the toner particle. The content of the charge control agent is preferably at least 0.2 mass parts and not more than 10.0 mass parts per 100 mass parts of the amorphous resin.

The toner may as necessary contain inorganic fine particles.

The inorganic fine particles may be internally added to the toner particle or may be mixed with the toner particle as an external additive.

Inorganic fine particles such as those of silica, titanium oxide, and aluminum oxide are preferred as external additives. The inorganic fine particles are preferably hydrophobed with a hydrophobic agent such as a silane compound, a silicone oil, or a mixture thereof.

When used as an external additive in order to improve the flowability, inorganic fine particles having a specific surface area of at least 50 $m^2/g$ and not more than 400 $m^2/g$ are preferred; in order to stabilize the durability, inorganic fine particles having a specific surface area of at least 10 $m^2/g$ and not more than 50 $m^2/g$ are preferred. Combinations of inorganic fine particles having specific surface areas in the indicated ranges may be used in order to bring about co-existence between flowability improvement and stabilization of the durability.

The content of this external additive is preferably at least 0.1 mass parts and not more than 10.0 mass parts per 100 mass parts of the toner particle. A known mixer, such as a Henschel mixer, can be used to mix the toner particle with the external additive.

The toner of the present invention may also be used as a single-component developer, but in order to further improve the dot reproducibility and provide a stable image on a long-term basis, it can also be mixed with a magnetic carrier and used as a two-component developer.

A commonly known magnetic carrier can be used for this magnetic carrier, for example, iron oxide; metal particles of, e.g., iron, lithium, calcium, magnesium, nickel, copper, zinc, cobalt, manganese, chromium, or a rare earth, as well as alloy particles of the preceding and oxide particles of the preceding; magnetic bodies such as ferrite; and magnetic body-dispersed resin carriers (known as resin carriers), which contain a magnetic body and a binder resin that holds this magnetic body in a dispersed state.

With regard to the mixing proportion for the magnetic carrier when the toner is used mixed with a magnetic carrier as a two-component developer, at least 2 mass % and not more than 15 mass % is preferred for the toner concentration in the two-component developer while at least 4 mass % and not more than 13 mass % is more preferred.

A toner production method is described in the following, but the toner production method is not limited to or by the following.

While there are no particular limitations on the toner production method, the use of a melt-kneading method is preferred from the standpoint of bringing about compatibilization of the amorphous resin and crystalline resin and thereby elaborating the maximum plasticizing effect.

This melt-kneading method is, for example, a method in which a resin composition containing the amorphous resin, crystalline resin, colorant, and release agent and optional additional substances is subjected to melt-kneading and the resulting kneaded material is cooled and subsequently pulverized and classified.

A toner production method using melt-kneading is detailed in the following, but this should not be construed as a limitation thereto.

The materials that will constitute the toner particle, i.e., the amorphous resin, crystalline resin, colorant, and release agent and additional optional components such as a charge control agent, are metered out in prescribed amounts and are blended and mixed.

The apparatus used for mixing can be exemplified by a double cone mixer, V-mixer, drum mixer, Supermixer, Henschel mixer, Nauta mixer, and Mechano Hybrid (Nippon Coke & Engineering Co., Ltd.).

The mixed material is then melt-kneaded and the crystalline resin, colorant, release agent and the like are thereby dispersed in the amorphous resin.

A batch kneader, e.g., a pressure kneader or Banbury mixer, or a continuous kneader can be used in the aforementioned melt-kneading step, and single-screw extruders and twin-screw extruders are the mainstream here because they offer the advantage of enabling continuous production. Examples here are the Model KTK twin-screw extruder (Kobe Steel, Ltd.), Model TEM twin-screw extruder (Toshiba Machine Co., Ltd.), PCM kneader (Ikegai Ironworks Corp.), Twin Screw Extruder (KCK), Co-Kneader (Buss AG), and Kneadex (Nippon Coke & Engineering Co., Ltd.).

The kneaded material yielded by melt-kneading is rolled out using, for example, a two-roll mill, and is cooled using, for example, water. The resulting cooled material is pulverized to a desired particle diameter using the following means to obtain resin particles.

For example, a coarse pulverization may be performed using a grinder such as a crusher, hammer mill, or feather mill, followed, for example, by a fine pulverization using a fine pulverizer such as a Kryptron System (Kawasaki Heavy Industries, Ltd.), Super Rotor (Nisshin Engineering Inc.), or Turbo Mill (Turbo Kogyo Co., Ltd.) or using an air jet system.

This may as necessary be followed by classification using a sieving apparatus or a classifier, e.g., an internal classification system such as the Elbow Jet (Nittetsu Mining Co., Ltd.) or a centrifugal classification system such as the Turboplex (Hosokawa Micron Corporation), TSP Separator (Hosokawa Micron Corporation), or Faculty (Hosokawa Micron Corporation).

Toner particles may be obtained by executing a heat treatment on the resulting resin particles. From the standpoints of the low-temperature fixability, storability, and charge retention performance, this heat treatment is preferably a treatment with a hot air current.

A specific example is given in the following of a method for executing a heat treatment on the resin particles using the heat-treatment apparatus shown in the FIGURE.

With the heat-treatment apparatus shown in the FIGURE, the resin particles are instantaneously melted using a hot air current and are quenched subsequent to this. By doing this, during toner use in a normal-temperature, normal-humidity environment, a state can be maintained in which the crystalline resin and amorphous resin are compatibilized and as a consequence a maximum plasticizing effect can be brought out and the low-temperature fixability can be improved. In addition, because the heat treatment is performed in a hydrophobic space in the air, the release agent, which is a constituent material of the toner, transfers to near the vicinity of the toner particle surface and due to this the hydrophobicity of the toner particle surface is increased, as a consequence of which the amount of moisture adsorption in high-temperature, high-humidity environments is reduced and reductions in the glass transition temperature of the toner particle and discharge of the charge from the toner particle can then be suppressed.

The average circularity of the toner particle can also be increased by this heat treatment.

The resin particles, which are metered and fed by a starting material metering and feed means 1, are conducted, by a compressed gas adjusted by a compressed gas flow rate adjustment means 2, to an introduction tube 3 that is disposed on the vertical line of a starting material feed means. The resin particles that have passed through the introduction tube 3 are uniformly dispersed by a conical projection member 4 that is disposed at the center of the starting material feed means and are introduced into an 8-direction feed tube 5 that extends radially and are introduced into a treatment compartment 6 in which the heat treatment is performed.

At this point, the flow of the resin particles fed into the treatment compartment 6 is regulated by a regulation means 9 that is disposed within the treatment compartment 6 in order to regulate the flow of the resin particles. As a result, the resin particles fed into the treatment compartment 6 are heat treated while rotating within the treatment compartment 6 and are thereafter cooled.

The hot air current for carrying out the heat treatment of the introduced resin particles is itself fed from a hot air current feed means 7 and is distributed by a distribution member 12, and the hot air current is introduced into the treatment compartment 6 having been caused to undergo a spiral rotation by a rotation member 13 for imparting rotation to the hot air current. With regard to its structure, the rotation member 13 for imparting rotation to the hot air current has a plurality of blades, and the rotation of the hot air current can be controlled using their number and angle (11 shows a hot air current feed means outlet). The hot air current fed into the treatment compartment 6 has a temperature at the outlet of the hot air current feed means 7 preferably of 100° C. to 300° C. When the temperature at the outlet of the hot air current feed means 7 resides in the indicated range, the particles can be uniformly treated while the melt adhesion and coalescence of the particles that would be induced by an excessive heating of the resin particles is prevented.

A hot air current is fed from the hot air current feed means 7. In addition, the heat-treated resin particles that have been heat treated are cooled by a cold air current fed from a cold air current feed means 8. The temperature of the cold air current fed from the cold air current feed means 8 is preferably between −20° C. and 30° C. When the cold air current temperature resides in this range, the heat-treated resin particles can be efficiently cooled and melt adhesion and coalescence of the heat-treated resin particles can be prevented without impairing the uniform heat treatment of the resin particles. The absolute amount of moisture in the cold air current is preferably at least 0.5 $g/m^3$ and not more than 15.0 $g/m^3$.

The cooled heat-treated resin particles are then recovered by a recovery means 10 residing at the lower end of the treatment compartment 6. A blower (not shown) is disposed at the end of the recovery means 10 and thereby forms a structure that carries out suction transport.

In addition, a powder particle feed port 14 is disposed so the rotational direction of the incoming resin particles is the same direction as the rotational direction of the hot air current, and the recovery means 10 is also disposed tangentially to the periphery of the treatment compartment 6 so as to maintain the rotational direction of the rotating resin particles. In addition, the cold air current fed from the cold air current feed means 8 is configured to be fed from a horizontal and tangential direction from the periphery of the apparatus to the circumferential surface within the treatment compartment. The rotational direction of the pre-heat-treatment resin particles fed from the powder particle feed port 14, the rotational direction of the cold air current fed from the cold air current feed means 8, and the rotational direction of the hot air current fed from the hot air current feed means 7 are all the same direction. As a consequence, flow perturbations within the treatment compartment 6 do not occur; the rotational flow within the apparatus is reinforced; a strong centrifugal force is applied to the resin particles prior to the heat treatment; and the dispersity of the resin particles prior to the heat treatment is further enhanced, as a result of which there are few coalesced particles and heat-treated resin particles with a uniform shape can be obtained.

The transferability is improved and can coexist with the cleaning performance when the average circularity of the toner is at least 0.950 and not more than 0.980, which is thus preferred.

The methods for measuring the various properties of the toner and starting materials are described in the following.

<Method for Calculating Solubility Parameter (Sp) of Amorphous Resin and Crystalline Resin>

The SP of the amorphous resin and crystalline resin is determined based on Fedors' equation.

The SP [unit: $(cal/cm^3)^{1/2}$] is defined as the square root of the cohesive energy density as shown in the formula below. Here, V is the molar volume ($cm^3$/mol) and E is the cohesive energy (energy of vaporization, cal/mol).

$$SP=(E/V)^{1/2}$$

The values of V and E used to calculate SP are given in Table 1.

In addition, the calculation methodology for the amorphous polyester resin A1 used in the examples is given in Table 2.

TABLE 1

| | E [cal/mol] | V [$cm^3$/mol] |
|---|---|---|
| —CH3 | 1125 | 33.5 |
| —CH2— | 1180 | 16.1 |
| >CH— | 820 | −1.0 |
| >C< | 350 | −19.2 |
| —CH═ | 1030 | 13.5 |
| —O— | 800 | 3.8 |
| —COOH | 6600 | 28.5 |
| —OH (Diol) | 5220 | 13.0 |
| —C6H4 (Arom) | 7630 | 52.4 |
| —C6H3 (Arom) | 7630 | 33.4 |

TABLE 2

| | | monomer | mole percent [mol %] | E [cal/mol] | V [$cm^3$/mol] | SP | mass parts [parts] | mol ratio [-I] | SP |
|---|---|---|---|---|---|---|---|---|---|
| A1 | alcohol | BPA-PO(2.2) | 100 | 35797 | 279 | 11.33 | 76.3 | 0.55 | 12.34 |
| | carboxylic acid | TPA | 60 | 20830 | 109 | 13.80 | 16.1 | 0.27 | |
| | | SA | 40 | 15560 | 89 | 13.21 | 7.6 | 0.18 | |

The abbreviations used in Table 2 are as follows.
BPA-PO(2.2): polyoxypropylene(2.2)-2,2-bis(4-hydroxyphenyl)propane
TPA: terephthalic acid
SA: succinic acid

Method for Measuring Weight-Average Molecular Weight (Mw) of Crystalline Resin The weight-average molecular weight of the crystalline resin is measured proceeding as follows using gel permeation chromatography (GPC).

First, the crystalline resin is dissolved in o-dichlorobenzene over 24 hours at room temperature. The obtained solution is filtered across a "Sample Pretreatment Cartridge" solvent-resistant membrane filter with a pore diameter of 0.2 μm (Tosoh Corporation) to obtain the sample solution. The sample solution is adjusted to an o-dichlorobenzene-soluble component concentration of approximately 0.1 mass %. The measurement is performed under the following conditions using this sample solution.

instrument: HLC-8121GPC/HT (Tosoh Corporation)
columns: 2× TSKgel GMHHR-H HT (7.8 cm I.D.×30 cm) (Tosoh Corporation)
detector: high-temperature RI
temperature: 135° C.
solvent: o-dichlorobenzene (with 0.05% IONOL added)
flow rate: 1.0 mL/min
sample: 0.4 mL of the 0.1% sample is injected A molecular weight calibration curve constructed using monodisperse polystyrene standard samples is used for calculation of the molecular weight of the sample. In addition, calculation as polyethylene is performed using a conversion formula derived from the Mark-Houwink viscosity equation.

Method for Measuring Peak Molecular Weight (Mp) of Amorphous Resin and Graft Polymer The peak molecular weight of the amorphous resin and graft polymer (polymer in which styrene-acrylic polymer is graft-polymerized on polyolefin) is measured as follows using gel permeation chromatography (GPC).

First, the toner is dissolved in tetrahydrofuran (THF) over 24 hours at room temperature. The obtained solution is filtered across a "Sample Pretreatment Cartridge" solvent-resistant membrane filter with a pore diameter of 0.2 μm (Tosoh Corporation) to obtain the sample solution. The sample solution is adjusted to a THF-soluble component concentration of approximately 0.8 mass %. The measurement is performed under the following conditions using this sample solution.

instrument: HLC8120 GPC (detector: RI) (Tosoh Corporation)
columns: 7-column train of Shodex KF-801, 802, 803, 804, 805, 806, and 807 (Showa Denko K.K.)
eluent: tetrahydrofuran (THF)
flow rate: 1.0 mL/min
oven temperature: 40.0° C.
sample injection amount: 0.10 mL The molecular weight calibration curve used to determine the molecular weight of the sample is constructed using polystyrene resin standards (product name: "TSK Standard Polystyrene F-850, F-450, F-288, F-128, F-80, F-40, F-20, F-10, F-4, F-2, F-1, A-5000, A-2500, A-1000, A-500", Tosoh Corporation).

Method for Measuring the Softening Point (Tm) of the Amorphous Resin, Graft Polymer, and Toner The softening point is measured using a "Flowtester CFT-500D Flow Property Evaluation Instrument" (Shimadzu Corporation), which is a constant-load extrusion-type capillary rheometer, in accordance with the manual provided with the instrument.

With this instrument, while a constant load is applied by a piston from the top of the measurement sample, the measurement sample filled in a cylinder is heated and melted and the melted measurement sample is extruded from a die at the bottom of the cylinder; a flow curve showing the relationship between piston stroke and temperature can be obtained from this.

The "melting temperature by the ½ method" described in the manual provided with the "Flowtester CFT-500D Flow Property Evaluation Instrument" is used as the softening point in the present invention.

The melting temperature by the ½ method is determined as follows.

First, ½ of the difference between Smax, which is the piston stroke at the completion of outflow, and Smin, which is the piston stroke at the start of outflow, is determined (this is designated as X, where X=(Smax−Smin)/2). The temperature of the flow curve when the piston stroke in the flow curve is the sum of X and Smin is the melting temperature by the ½ method.

The measurement sample used is prepared by subjecting approximately 1.0 g of the sample to compression molding for approximately 60 seconds at approximately 10 MPa in a 25° C. environment using a tablet compression molder (for example, NT-100H, from NPa System Co., Ltd.) to provide a cylindrical shape with a diameter of approximately 8 mm.

The measurement conditions with the CFT-500D are as follows.

test mode: ramp-up method
start temperature: 50° C.
saturated temperature: 200° C.
measurement interval: 1.0° C.
ramp rate: 4.0° C./min
piston cross section area: 1.000 $cm^2$
test load (piston load): 10.0 kgf (0.9807 MPa)
preheating time: 300 seconds
diameter of die orifice: 1.0 mm
die length: 1.0 mm

Method for Measuring Glass Transition Temperature (Tg) of Amorphous Resin and Toner The glass transition temperature is measured based on ASTM D 3418-82 using a "Q2000" differential scanning calorimeter (TA Instruments).

Temperature correction in the instrument detection section is performed using the melting points of indium and zinc, and the amount of heat is corrected using the heat of fusion of indium.

Specifically, approximately 3 mg of the sample is exactly weighed out and this is introduced into an aluminum pan, and the measurement is run under the following conditions using an empty aluminum pan as reference.

ramp rate: 10° C./min
measurement start temperature: 30° C.
measurement end temperature: 180° C.

The measurement is carried out at a ramp rate of 10° C./min in the measurement range from 30° C. to 180° C. Heating is carried out to 180° C. followed by holding for 10 minutes then cooling to 30° C. and subsequently reheating.

The change in specific heat in the temperature range from 30° C. to 100° C. is acquired in this second heating process. The glass transition temperature (Tg) is then taken to be the point at the intersection between the differential heat curve and the line for the midpoint for the baselines for prior to and subsequent to the appearance of the change in the specific heat.

Method for Measuring Melting Point of Crystalline Resin

The melting point of the crystalline resin is measured based on ASTM D 3418-82 using a "Q2000" differential scanning calorimeter (TA Instruments).

Temperature correction in the instrument detection section is performed using the melting points of indium and zinc, and the amount of heat is corrected using the heat of fusion of indium.

Specifically, approximately 3 mg of the sample is exactly weighed out and this is introduced into an aluminum pan, and the measurement is run under the following conditions using an empty aluminum pan as reference.

ramp rate: 10° C./min
measurement start temperature: 30° C.
measurement end temperature: 180° C.

The measurement is carried out at a ramp rate of 10° C./min in the measurement range from 30° C. to 180° C.

In the measurement, the sample is heated to 50° C. and is held there for 3 days. This is followed by cooling from 50° C. to 30° C.

Reheating is then performed. In this second heating process, endothermic peaks relative to the base line are acquired in the temperature range from 30° C. to 180° C.

The melting point [unit: ° C.] is taken to be the peak temperature of the maximum endothermic peak in the differential scanning calorimetric curve in the temperature range from 30° C. to 180° C. in the second heating process.

When the endothermic peak can be separated from enthalpic relaxation and the endothermic peak originating with the release agent, this endothermic peak is used as the endothermic peak originating with the crystalline resin.

On the other hand, when the obtained endothermic peak cannot be separated from enthalpic relaxation or the endothermic peak originating from the release agent, or when the compatibility between the amorphous resin and crystalline resin is high and an endothermic peak does not appear, the measurement is then carried out after the crystalline resin has been separated from the toner utilizing differences in solvent solubility.

Method for Measuring Weight-Average Particle Diameter (D4) of Toner

Using a "Coulter Counter Multisizer 3" (registered trademark, Beckman Coulter, Inc.), a precision particle size distribution measurement instrument operating on the pore electrical resistance method and equipped with a 100 μm aperture tube, and the accompanying dedicated software, i.e., "Beckman Coulter Multisizer 3 Version 3.51" (Beckman Coulter, Inc.), for setting the measurement conditions and analyzing the measurement data, the weight-average particle diameter (D4) of the toner is determined by performing the measurement in 25,000 channels for the number of effective measurement channels and analyzing the measurement data.

The aqueous electrolyte solution used for the measurements is prepared by dissolving special-grade sodium chloride in deionized water to provide a concentration of approximately 1 mass % and, for example, "ISOTON II" (Beckman Coulter, Inc.) can be used.

The dedicated software is configured as follows prior to measurement and analysis.

In the "modify the standard operating method (SOM)" screen in the dedicated software, the total count number in the control mode is set to 50,000 particles; the number of measurements is set to 1 time; and the Kd value is set to the value obtained using "standard particle 10.0 μm" (Beckman Coulter, Inc.). The threshold value and noise level are automatically set by pressing the threshold value/noise level measurement button. In addition, the current is set to 1600

μA; the gain is set to 2; the electrolyte is set to ISOTON II; and a check is entered for the post-measurement aperture tube flush.

In the "setting conversion from pulses to particle diameter" screen of the dedicated software, the bin interval is set to logarithmic particle diameter; the particle diameter bin is set to 256 particle diameter bins; and the particle diameter range is set to at least 2 μm and not more than 60 μm.

The specific measurement procedure is as follows.

(1) Approximately 200 mL of the above-described aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the "aperture flush" function of the dedicated software.

(2) Approximately 30 mL of the above-described aqueous electrolyte solution is introduced into a 100-mL flatbottom glass beaker. To this is added as dispersing agent approximately 0.3 mL of a dilution prepared by the three-fold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, Wako Pure Chemical Industries, Ltd.).

(3) A prescribed amount of deionized water is introduced into the water tank of an "Ultrasonic Dispersion System Tetora 150" (Nikkaki Bios Co., Ltd.), which is an ultrasound disperser with an electrical output of 120 W and equipped with two oscillators (oscillation frequency=50 kHz) disposed such that the phases are displaced by 180°, and approximately 2 mL of Contaminon N is added to this water tank.

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of the toner is added to the aqueous electrolyte solution in small aliquots and dispersion is carried out. The ultrasound dispersion treatment is continued for an additional 60 seconds. The water temperature in the water tank is controlled as appropriate during ultrasound dispersion to be at least 10° C. and not more than 40° C.

(6) Using a pipette, the dispersed toner-containing aqueous electrolyte solution prepared in (5) is dripped into the roundbottom beaker set in the sample stand as described in (1) with adjustment to provide a measurement concentration of approximately 5%. Measurement is then performed until the number of measured particles reaches 50,000.

(7) The measurement data is analyzed by the previously cited dedicated software provided with the instrument and the weight-average particle diameter (D4) is calculated. When set to graph/volume % with the dedicated software, the "average diameter" on the analysis/volumetric statistical value (arithmetic average) screen is the weight-average particle diameter (D4).

Method for Measuring Average Circularity of Toner

The average circularity of the toner is measured using an "FPIA-3000" (Sysmex Corporation), a flow-type particle image analyzer, and using the measurement and analysis conditions from the calibration process.

The specific measurement method is as follows.

First, approximately 20 mL of deionized water from which solid impurities and so forth have been preliminarily removed, is introduced into a glass container. To this is added as dispersing agent approximately 0.2 mL of a dilution prepared by the approximately three-fold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, Wako Pure Chemical Industries, Ltd.).

Approximately 0.02 g of the measurement sample is added and a dispersion treatment is carried out for 2 minutes using an ultrasound disperser to provide a dispersion to be used for the measurement. Cooling is carried out as appropriate during this process in order to have the temperature of the dispersion be at least 10° C. and not more than 40° C. A benchtop ultrasound cleaner/disperser having an oscillation frequency of 50 kHz and an electrical output of 150 W ("VS-150" (Velvo-Clear Co., Ltd.)) is used as the ultrasound disperser, and a prescribed amount of deionized water is introduced into the water tank and approximately 2 mL of Contaminon N is added to the water tank.

The previously cited flow particle image analyzer fitted with a standard objective lens (10×) is used for the measurement, and "PSE-900A" (Sysmex Corporation) particle sheath is used for the sheath solution. The dispersion prepared according to the procedure described above is introduced into the flow particle image analyzer, and 3,000 toner particles are measured by total count mode in HPF measurement mode.

The average circularity of the toner is determined with the binarization threshold value during particle analysis set at 85% and the analyzed particle diameter set to a circle-equivalent diameter of at least 1.98 μm and not more than 39.96 μm.

For this measurement, automatic focal point adjustment is performed prior to the start of the measurement using reference latex particles (for example, a dilution with deionized water of "RESEARCH AND TEST PARTICLES Latex Microsphere Suspensions 5200A", Duke Scientific Corporation). After this, focal point adjustment is preferably performed every two hours after the start of measurement.

Method for Separating Amorphous Resin, Crystalline Resin, and so Forth from Toner The individual materials can be separated from the toner utilizing differences in solvent solubilities.

First separation: the toner is dissolved in methyl ethyl ketone (MEK) at 23° C. and the soluble matter (amorphous resin, graft polymer) is separated from the insoluble matter (crystalline resin, release agent, colorant, inorganic fine particles, and so forth).

Second separation: the insoluble matter (crystalline resin, release agent, colorant, inorganic fine particles) yielded by the first separation is dissolved in 100° C. MEK and the soluble matter (crystalline resin, release agent) is separated from the insoluble matter (colorant, inorganic fine particles).

Third separation: the soluble matter (crystalline resin, release agent) yielded by the second separation is dissolved in 23° C. chloroform and the soluble matter (crystalline resin) is separated from the insoluble matter (release agent).

Structural Determination for Amorphous Resin and Graft Polymer

The structure of the amorphous resin and graft polymer and so forth is determined using a nuclear magnetic resonance instrument ($^1$H-NMR) and the FT-IR spectrum.

The instrumentation and measurement method used in the measurements are described in the following.

(i)$^1$H-NMR measurement instrument: JNM-ECA400 FT-NMR instrument (JEOL Ltd.)
measurement frequency: 500 MHz
pulse condition: 10 μs
frequency range: 10330 Hz
number of integrations: 16
measurement temperature: 25° C.

50 mg of the sample is introduced into a sample tube having an inner diameter of 5 mm; deuterochloroform ($CDCl_3$) is added as solvent; and the measurement sample is prepared by dissolution at 25° C. Measurement was performed using the aforementioned conditions and using this measurement sample.

(ii) FT-IR spectrum measurement instrument: Spectrum One (PerkinElmer Inc.)
measurement method: single reflection ATR
Range Start: 4000 $cm^{-1}$
End: 400 $cm^{-1}$ (KRS-5 ATR crystal)
Scan number: 40
Resolution: 4.00 $cm^{-1}$
Advanced: $CO_2/H_2O$ correction 0.01 g of the sample is exactly weighed out onto the ATR crystal and pressure is applied to the sample using the clamp arm. Measurement was performed on this sample under the conditions given above.

EXAMPLES

The present invention is more specifically described in the following using production examples and examples, but these in no way limit the present invention. Unless specifically indicated otherwise, the number of parts and % for the following blends are on a mass basis in all instances.

Amorphous Polyester Resin A1 Production Example

| | |
|---|---|
| polyoxypropylene(2.2)-2,2-bis(4-hydroxyphenyl)propane (0.19 moles, 100.0 mol % with reference to the total number of moles of polyhydric alcohol) | 76.3 parts |
| terephthalic acid (0.10 moles, 60.0 mol % with reference to the total number of moles of polyhydric carboxylic acid) | 16.1 parts |
| succinic acid (0.06 moles, 40.0 mol % with reference to the total number of moles of polyhydric carboxylic acid) | 7.6 parts |
| titanium tetrabutoxide (esterification catalyst) | 0.5 parts |

These substances were weighed into a reaction vessel fitted with a condenser, stirrer, nitrogen introduction line, and thermocouple.

The interior of the reaction vessel was subsequently substituted with nitrogen gas; the temperature was then gradually raised while stirring; and a reaction was run for 4 hours while stirring at a temperature of 200° C.

The pressure within the reaction vessel was dropped to 8.3 kPa; holding was carried out for 1 hour; and then cooling to 160° C. and return to atmospheric pressure were performed (first reaction process).

tert-butylcatechol (polymerization inhibitor) 0.1 parts

This substance was then added and the pressure within the reaction vessel was dropped to 8.3 kPa and the temperature was held at 180° C. and a reaction was carried out for 1 hour in this condition. After confirming that the softening point, as measured in accordance with ASTM D 36-86, had reached 90° C., the temperature was lowered and the reaction was stopped (second reaction process), thereby yielding resin A1.

The resulting amorphous polyester resin A1 had a peak molecular weight (Mp) of 4,500, a softening point (Tm) of 90° C., a glass transition temperature (Tg) of 54° C., and an SP(A) of 12.34.

Amorphous Polyester Resins A2 to A9 Production Example

Amorphous polyester resins A2 to A9 were obtained by running a reaction proceeding as in the Amorphous Polyester Resin A1 Production Example, but in the first reaction process changing the reaction conditions and the monomer and number of mass parts for the polyhydric alcohol and/or the polyhydric carboxylic acid as shown in Table 3-1, and in the second reaction process changing the reaction conditions as shown in Table 3-1. The properties of amorphous polyester resins A2 to A9 are shown in Table 3-2.

TABLE 3-1

| | first reaction process | | | | | | | | | | | |
|---|---|---|---|---|---|---|---|---|---|---|---|---|
| | polyhydric alcohol monomer | | | | | | | | polyhydric carboxylic acid monomer | | | |
| amorphous polyester resin | designation | mass parts | number of moles [mol] | mol % [%] | designation | mass parts | number of moles [mol] | mol % [%] | designation | mass parts | number of moles [mol] | mol % [%] |
| A1 | BPA-PO | 76.3 | 0.19 | 100.0 | — | — | — | — | TPA | 16.1 | 0.10 | 60.0 |
| A2 | BPA-PO | 77.2 | 0.20 | 100.0 | — | — | — | — | TPA | 12.0 | 0.07 | 44.0 |

TABLE 3-1-continued

| | | | | | | | | | | | | |
|---|---|---|---|---|---|---|---|---|---|---|---|---|
| A3 | BPA-PO | 75.2 | 0.19 | 100.0 | — | — | — | — | TPA | 20.6 | 0.12 | 78.0 |
| A4 | BPA-PO | 77.2 | 0.20 | 100.0 | — | — | — | — | TPA | 12.0 | 0.12 | 78.0 |
| A5 | BPA-PO | 75.2 | 0.19 | 100.0 | — | — | — | — | TPA | 20.6 | 0.12 | 78.0 |
| A6 | BPA-PO | 69.8 | 0.18 | 91.0 | BPA-EO | 6.4 | 0.02 | 9.0 | TPA | 16.2 | 0.10 | 60.0 |
| A7 | BPA-PO | 77.9 | 0.20 | 100.0 | — | — | — | — | TPA | 9.0 | 0.05 | 33.0 |
| A8 | BPA-PO | 74.6 | 0.19 | 100.0 | — | — | — | — | TPA | 23.4 | 0.14 | 89.0 |
| A9 | BPA-PO | 64.0 | 0.16 | 82.0 | BPA-EO | 13.0 | 0.04 | 18.0 | TPA | 12.1 | 0.07 | 44.0 |

| | first reaction process | | | | | | | second reaction process | |
|---|---|---|---|---|---|---|---|---|---|
| | polyhydric carboxylic acid monomer | | | | | reaction conditions | | reaction conditions | |
| amorphous polyester resin | designation | mass parts | number of moles [mol] | mol % [%] | | temperature [° C.] | time [h] | temperature [° C.] | time [h] |
| A1 | SA | 7.6 | 0.06 | 40.0 | | 200 | 4 | 180 | 1 |
| A2 | SA | 10.8 | 0.09 | 56.0 | | 200 | 4 | 180 | 1 |
| A3 | SA | 4.1 | 0.04 | 22.0 | | 200 | 4 | 180 | 1 |
| A4 | SA | 10.8 | 0.09 | 56.0 | | 200 | 5 | 180 | 2 |
| A5 | SA | 4.1 | 0.04 | 22.0 | | 200 | 4 | 180 | 1 |
| A6 | SA | 7.7 | 0.07 | 40.0 | | 200 | 4 | 180 | 1 |
| A7 | SA | 13.1 | 0.11 | 67.0 | | 200 | 4 | 180 | 1 |
| A8 | SA | 2.1 | 0.02 | 11.0 | | 200 | 4 | 180 | 1 |
| A9 | SA | 10.9 | 0.09 | 56.0 | | 200 | 4 | 180 | 1 |

In Table 3-1, BPA-PO refers to polyoxypropylene(2.2)-2,2-bis(4-hydroxyphenyl)propane; BPA-EO refers to polyoxyethylene(2.2)-2,2-bis(4-hydroxyphenyl)propane; TPA refers to terephthalic acid; and SA refers to succinic acid.

TABLE 3-2

| amorphous polyester resin | properties | | | |
|---|---|---|---|---|
| | Mp | Tg [° C.] | Tm [° C.] | SP(A) |
| A1 | 4500 | 54 | 90 | 12.34 |
| A2 | 4700 | 54 | 90 | 12.30 |
| A3 | 4200 | 54 | 90 | 12.38 |
| A4 | 4900 | 57 | 94 | 12.30 |
| A5 | 4000 | 50 | 85 | 12.38 |
| A6 | 4900 | 54 | 90 | 12.38 |
| A7 | 5200 | 54 | 90 | 12.27 |
| A8 | 3800 | 54 | 90 | 12.41 |
| A9 | 5700 | 54 | 90 | 12.38 |

Amorphous Polyester Resin B1 Production Example polyoxypropylene(2.2)-2,2-bis(4-hydroxyphenyl)propane (0.19 moles, 100.0 mol % with reference to the total number of moles of polyhydric alcohol) 73.8 parts terephthalic acid 12.5 parts (0.08 moles, 48.0 mol % with reference to the total number of moles of polyhydric carboxylic acid)

adipic acid 7.8 parts (0.05 moles, 34.0 mol % with reference to the total number of moles of polyhydric carboxylic acid)

titanium tetrabutoxide (esterification catalyst) 0.5 parts

These substances were weighed into a reaction vessel fitted with a condenser, stirrer, nitrogen introduction line, and thermocouple.

The interior of the reaction vessel was subsequently substituted with nitrogen gas; the temperature was then gradually raised while stirring; and a reaction was run for 2 hours while stirring at a temperature of 200° C.

The pressure within the reaction vessel was dropped to 8.3 kPa; holding was carried out for 1 hour; and then cooling to 160° C. and return to atmospheric pressure were performed (first reaction process).

trimellitic anhydride 5.9 parts (0.03 moles, 18.0 mol % with reference to the total number of moles of polyhydric carboxylic acid)

tert-butylcatechol (polymerization inhibitor) 0.1 parts

These substances were then added and the pressure within the reaction vessel was dropped to 8.3 kPa and the temperature was held at 200° C. and a reaction was carried out for 15 hours in this condition. After confirming that the softening point, as measured in accordance with ASTM D 36-86, had reached 140° C., the temperature was lowered and the reaction was stopped (second reaction process), thereby yielding resin B1.

The resulting amorphous polyester resin B1 had a peak molecular weight (Mp) of 10,000, a softening point (Tm) of 140° C., and a glass transition temperature (Tg) of 60° C.

Crystalline Polyester Resin C1 Production Example hexanediol 33.9 parts (0.29 moles, 100.0 mol % with reference to the total number of moles of polyhydric alcohol)

dodecanedioic acid 66.1 parts (0.29 moles, 100.0 mol % with reference to the total number of moles of polyhydric carboxylic acid)

These substances were weighed into a reaction vessel fitted with a condenser, stirrer, nitrogen introduction line, and thermocouple.

The interior of the reaction vessel was subsequently substituted with nitrogen gas; the temperature was then gradually raised while stirring; and a reaction was run for 3 hours while stirring at a temperature of 140° C.

tin 2-ethylhexanoate 0.5 parts

This substance was then added and the pressure within the reaction vessel was dropped to 8.3 kPa and the temperature was held at 200° C. and a reaction was carried out for 4 hours in this condition to obtain a crystalline polyester resin C1.

The resulting crystalline polyester resin C1 had a weight-average molecular weight (Mw) of 10,000, a melting point of 71° C., and an SP(C) of 11.33.

Crystalline Polyester Resins C2 to C5 Production Example

Crystalline polyester resins C2 to C5 were obtained by carrying out reactions proceeding as in the Crystalline Polyester Resin C1 Production Example, but changing the monomer and number of mass parts for the polyhydric alcohol and/or polyhydric carboxylic acid as indicated in Table 4. The properties of crystalline polyester resins C2 to C5 are given in Table 4.

Graft Polymer D1 Production Example

| | |
|---|---|
| polypropylene<br>(Sanyo Chemical Industries, Ltd., VISCOL 660P)<br>(0.03 moles, 3.1 mol % with reference to the total number of moles of monomer for producing the graft polymer) | 12.5 parts |
| xylene | 25.0 parts |

These substances were weighed into a reaction vessel fitted with a condenser, stirrer, nitrogen introduction line, and thermocouple.

The interior of the reaction vessel was subsequently substituted with nitrogen gas and the temperature was then gradually raised to 175° C. while stirring.

| | |
|---|---|
| styrene<br>(0.68 moles, 82.5 mol % with reference to the total number of moles of monomer for producing the graft polymer) | 70.9 parts |
| cyclohexyl methacrylate<br>(0.03 moles, 4.1 mol % with reference to the total number of moles of monomer for producing the graft polymer) | 5.7 parts |
| butyl acrylate<br>(0.09 moles, 10.3 mol % with reference to the total number of moles of monomer for producing the graft polymer) | 10.9 parts |
| xylene | 10.0 parts |
| di-t-butyl peroxyhexahydroterephthalate | 0.5 parts |

These substances were then added dropwise over 3 hours and stirring was carried out for an additional 30 minutes. The solvent was subsequently distilled off to obtain a graft polymer D1. The obtained graft polymer D1 had a peak molecular weight (Mp) of 50,000 and a softening point (Tm) of 125° C.

Graft Polymer D2 Production Example

A graft polymer D2 was obtained by carrying out a reaction proceeding as in the Graft Polymer D1 Production Example, but changing the monomer and number of mass parts as shown in Table 5. The properties of graft polymer D2 are given in Table 5.

TABLE 4

| | polyhydric alcohol monomer | | | | polyhydric carboxylic acid monomer | | | | properties | | |
|---|---|---|---|---|---|---|---|---|---|---|---|
| crystalline polyester resin | designation | mass parts | number of moles [mol] | mol % [%] | designation | mass parts | number of moles [mol] | mol % [%] | Mw | melting point [° C.] | SP(C) |
| C1 | HG | 33.9 | 0.29 | 100.0 | DDA | 66.1 | 0.29 | 100.0 | 10000 | 71 | 11.33 |
| C2 | HG | 34.4 | 0.29 | 100.0 | DDA | 64.3 | 0.28 | 96.0 | 10000 | 70 | 11.39 |
| | — | — | — | — | FA | 1.4 | 0.01 | 4.0 | | | |
| C3 | NG | 44.2 | 0.28 | 100.0 | SEA | 55.8 | 0.28 | 100.0 | 10000 | 74 | 11.07 |
| C4 | HG | 36.9 | 0.31 | 100.0 | SEA | 63.1 | 0.31 | 100.0 | 10000 | 69 | 11.50 |
| C5 | DG | 46.3 | 0.27 | 100.0 | SEA | 53.7 | 0.27 | 100.0 | 10000 | 76 | 10.97 |

The abbreviations in Table 4 are as follows.

HG: hexanediol

NG: nonanediol

DG: dodecanediol

DDA: dodecanedioic acid

FA: fumaric acid

SEA: sebacic acid

TABLE 5

| graft polymer | monomer designation | monomer mass parts | monomer mol % [%] | monomer designation | monomer mass parts | monomer mol % [%] | monomer designation | monomer mass parts | monomer mol % [%] | monomer designation | monomer mass parts | monomer mol % [%] | properties Mp | properties Tm [° C.] |
|---|---|---|---|---|---|---|---|---|---|---|---|---|---|---|
| D1 | PP | 12.5 | 3.1 | ST | 70.9 | 82.5 | CHMA | 5.7 | 4.1 | BA | 10.9 | 10.3 | 50000 | 125 |
| D2 | PP | 12.6 | 3.0 | ST | 71.2 | 80.0 | MMA | 8.6 | 10.0 | BA | 7.7 | 7.0 | 60000 | 130 |

The abbreviations used in Table 5 are as follows.
PP: polypropylene
ST: styrene
CHMA: cyclohexyl methacrylate
MMA: methyl methacrylate
BA: butyl acrylate

Toner 1 Production Example

| | |
|---|---|
| amorphous polyester resin A1 | 60.0 parts |
| amorphous polyester resin B1 | 30.0 parts |
| crystalline polyester resin C1 | 10.0 parts |
| graft polymer D1 | 4.0 parts |
| Fischer-Tropsch wax (peak temperature of maximum endothermic peak = 90° C.) | 4.0 parts |
| C.I. Pigment Blue 15:3 | 7.0 parts |

These substances were mixed using a Henschel mixer (Model FM-75, Mitsui Mining Co., Ltd.) at a rotation rate of 20 $s^{-1}$ for a rotation time of 5 minutes; this was followed by melt-kneading with a twin-screw kneader (Model PCM-30, Ikegai Corp) set to a temperature of 130° C.

The resulting kneaded material was cooled and coarsely pulverized to 1 mm and below using a hammer mill to obtain a coarsely pulverized material.

The obtained coarsely pulverized material was finely pulverized using a mechanical pulverizer (T-250, Turbo Kogyo Co., Ltd.).

Classification was also carried out using a Faculty F-300 (Hosokawa Micron Corporation) to obtain resin particles. The operating conditions were a classification rotor rotation rate of 130 $s^{-1}$ and a dispersion rotor rotation rate of 120 $s^{-1}$.

The resulting resin particles were heat treated using the heat-treatment apparatus shown in the FIGURE to obtain toner particles.

The operating conditions were as follows: feed rate=5 kg/hr; hot air current temperature=160° C.; hot air current flow rate=6 $m^3$/min; cold air current temperature=−5° C.; cold air current flow rate=4 $m^3$/min; blower output=20 $m^3$/min; and injection air flow rate=1 $m^3$/min.

A toner 1 was obtained by mixing—using a Henschel mixer (Model FM-75, Mitsui Miike Chemical Engineering Machinery Co., Ltd.) at a rotation rate of 30 $s^{-1}$ and a rotation time of 10 minutes-100 mass parts of the toner particles; 1.0 parts of hydrophobic silica fine particles (BET: 200 $m^2$/g) that had been surface-treated with hexamethyldisilazane; and 1.0 parts of titanium oxide fine particles (BET: 80 $m^2$/g) that had been surface-treated with isobutyltrimethoxysilane.

Toner 1 had a weight-average particle diameter (D4) of 6.5 μm and an average circularity of 0.968. The properties of toner 1 are given in Table 6.

Toners 2 to 15 Production Example

Toner 2 to toner 15 were obtained by carrying out the same process as in the Toner 1 Production Example, but omitting the step with the heat-treatment apparatus and changing the amorphous polyester resin A1, crystalline polyester resin C1, and graft polymer D1 as shown in Table 6. The properties of toner 2 to toner 15 are given in Table 6.

TABLE 6

| toner No. | formulation resin A | mass parts | resin B | mass parts | resin C | mass parts | graft polymer D | mass parts | heat treatment | properties D4 [μm] | average circularity | SP(A) − SP(C) | Tm [° C.] | Tg [° C.] |
|---|---|---|---|---|---|---|---|---|---|---|---|---|---|---|
| 1 | A1 | 60.0 | B1 | 30.0 | C1 | 10.0 | D1 | 4.0 | yes | 6.5 | 0.968 | 1.01 | 95 | 37 |
| 2 | A1 | 60.0 | B1 | 30.0 | C1 | 10.0 | D1 | 4.0 | no | 6.5 | 0.955 | 1.01 | 97 | 38 |
| 3 | A1 | 60.0 | B1 | 30.0 | C1 | 10.0 | D2 | 4.0 | no | 6.5 | 0.955 | 1.01 | 98 | 39 |
| 4 | A1 | 60.0 | B1 | 30.0 | C2 | 10.0 | D2 | 4.0 | no | 6.5 | 0.955 | 0.95 | 97 | 38 |
| 5 | A1 | 60.0 | B1 | 30.0 | C3 | 10.0 | D2 | 4.0 | no | 6.5 | 0.955 | 1.27 | 100 | 42 |
| 6 | A1 | 60.0 | B1 | 30.0 | C4 | 10.0 | D2 | 4.0 | no | 6.5 | 0.955 | 0.84 | 95 | 37 |
| 7 | A1 | 60.0 | B1 | 30.0 | C5 | 10.0 | D2 | 4.0 | no | 6.5 | 0.955 | 1.37 | 103 | 44 |
| 8 | A2 | 60.0 | B1 | 30.0 | C5 | 10.0 | D2 | 4.0 | no | 6.5 | 0.955 | 1.33 | 104 | 45 |
| 9 | A3 | 60.0 | B1 | 30.0 | C5 | 10.0 | D2 | 4.0 | no | 6.5 | 0.955 | 1.41 | 102 | 43 |
| 10 | A4 | 60.0 | B1 | 30.0 | C5 | 10.0 | D2 | 4.0 | no | 6.5 | 0.955 | 1.33 | 105 | 48 |
| 11 | A5 | 60.0 | B1 | 30.0 | C5 | 10.0 | D2 | 4.0 | no | 6.5 | 0.955 | 1.41 | 101 | 42 |
| 12 | A6 | 60.0 | B1 | 30.0 | C5 | 10.0 | D2 | 4.0 | no | 6.5 | 0.955 | 1.41 | 106 | 49 |
| 13 | A7 | 60.0 | B1 | 30.0 | C5 | 10.0 | D2 | 4.0 | no | 6.5 | 0.955 | 1.30 | 107 | 50 |
| 14 | A8 | 60.0 | B1 | 30.0 | C5 | 10.0 | D2 | 4.0 | no | 6.5 | 0.955 | 1.44 | 100 | 41 |
| 15 | A9 | 60.0 | B1 | 30.0 | C5 | 10.0 | D2 | 4.0 | no | 6.5 | 0.955 | 1.41 | 109 | 52 |

Magnetic Core Particle 1 Production Example

Step 1 (Weighing•Mixing Step):

| | |
|---|---|
| $Fe_2O_3$ | 62.7 parts |
| $MnCO_3$ | 29.5 parts |
| $Mg(OH)_2$ | 6.8 parts |
| $SrCO_3$ | 1.0 parts |

The ferrite starting materials were weighed out so that these materials assumed the composition ratio given above. This was followed by pulverization and mixing for 5 hours using a dry vibrating mill and stainless steel beads having a diameter of ⅛-inch.

Step 2 (pre-firing step):

The obtained pulverizate was converted into approximately 1 mm-square pellets using a roller compactor. After removal of the coarse powder using a vibrating screen having an aperture of 3 mm and subsequent removal of the fines using a vibrating screen having an aperture of 0.5 mm, the pellets were fired for 4 hours at a temperature of 1,000° C. in a burner-type firing furnace under a nitrogen atmosphere (oxygen concentration: 0.01 volume %) to produce a pre-fired ferrite. The composition of the resulting pre-fired ferrite was as follows.

$$(MnO)_a(MgO)_b(SrO)_c(Fe_2O_3)_d$$

In this formula, a=0.257, b=0.117, c=0.007, d=0.393.

Step 3 (Pulverization Step):

The resulting pre-fired ferrite was pulverized to about 0.3 mm with a crusher followed by pulverization for 1 hour with a wet ball mill using zirconia beads having a diameter of ⅛-inch and with the addition of 30 parts of water per 100 parts of the pre-fired ferrite. The obtained slurry was milled for 4 hours using a wet ball mill using alumina beads with a diameter of 1/16-inch to obtain a ferrite slurry (finely pulverized pre-fired ferrite).

Step 4 (Granulation Step):

1.0 parts of an ammonium polycarboxylate as a dispersing agent and 2.0 parts of polyvinyl alcohol as a binder per 100 parts of the pre-fired ferrite were added to the ferrite slurry, followed by granulation with a spray dryer (manufacturer: Ohkawara Kakohki Co., Ltd.) into spherical particles. Particle size adjustment was carried out on the obtained particles, which were subsequently heated for 2 hours at 650° C. using a rotary kiln to remove the organic components, e.g., the dispersing agent and binder.

Step 5 (Firing Step):

In order to control the firing atmosphere, the temperature was raised over 2 hours from room temperature to a temperature of 1,300° C. in an electric furnace under a nitrogen atmosphere (oxygen concentration: 1.00 volume %); firing was then carried out for 4 hours at a temperature of 1,150° C. This was followed by cooling to a temperature of 60° C. over 4 hours; return to the atmosphere from the nitrogen atmosphere; and removal at a temperature at or below 40° C.

Step 6 (Classification Step):

After the aggregated particles had been crushed, the weakly magnetic fraction was cut off by magnetic separation and the coarse particles were removed by sieving on a sieve with an aperture of 250 μm to obtain a magnetic core particle 1 having a 50% particle diameter on a volume basis (D50) of 37.0 μm.

Preparation of Coating Resin 1

| | |
|---|---|
| cyclohexyl methacrylate monomer | 26.8 mass % |
| methyl methacrylate monomer | 0.2 mass % |
| methyl methacrylate macromonomer (macromonomer having a weight-average molecular weight of 5,000 and having the methacryloyl group at one terminal) | 8.4 mass % |
| toluene | 31.3 mass % |
| methyl ethyl ketone | 31.3 mass % |
| azobisisobutyronitrile | 2.0 mass % |

Of these materials, the cyclohexyl methacrylate monomer, methyl methacrylate monomer, methyl methacrylate macromonomer, toluene, and methyl ethyl ketone were introduced into a four-neck separable flask fitted with a reflux condenser, thermometer, nitrogen introduction line, and stirring apparatus, and nitrogen gas was introduced to carry out a thorough conversion into a nitrogen atmosphere. This was followed by heating to 80° C. and addition of the azobisisobutyronitrile and polymerization for 5 hours under reflux. The copolymer was precipitated by pouring hexane into the obtained reaction product and the precipitate was separated by filtration and then vacuum dried to obtain a coating resin 1.

30 parts of the coating resin 1 was then dissolved in 40 parts of toluene and 30 parts of methyl ethyl ketone to obtain a polymer solution 1 (30 mass % solids).

Preparation of Coating Resin Solution 1 polymer solution 1 (30% resin solids concentration) 33.3 mass % toluene 66.4 mass % carbon black (Regal 330, Cabot Corporation) 0.3 mass % (primary particle diameter=25 nm, specific surface area by nitrogen adsorption=94 $m^2/g$, DBP absorption=75 mL/100 g)

were dispersed for 1 hour using a paint shaker and zirconia beads having a diameter of 0.5 mm. The obtained dispersion was filtered on a 5.0-μm membrane filter to obtain a coating resin solution 1.

Magnetic Carrier 1 Production Example (Resin Coating Step)

The magnetic core particle 1 and the coating resin solution 1 were introduced into a vacuum-degassed kneader being maintained at normal temperature (the amount of introduction for the coating resin solution 1 was an amount that provided 2.5 parts as the resin component per 100 parts of the magnetic core particle 1). After introduction, stirring was performed for 15 minutes at a rotation rate of 30 rpm and, after at least a certain amount (80 mass %) of the solvent had been evaporated, the temperature was raised to 80° C. while mixing under reduced pressure and the toluene was distilled off over 2 hours followed by cooling. The obtained magnetic carrier, after fractionation and separation of the weakly magnetic product by magnetic selection and passage through a screen having an aperture of 70 μm, was classified using an air classifier to obtain a magnetic carrier 1 having a 50% particle diameter on a volume basis (D50) of 38.2 μm.

Two-Component Developer 1 Production Example 8.0 parts of toner 1 was added to 92.0 parts of magnetic carrier 1 and mixing was performed using a V-mixer (V-20, Seishin Enterprise Co., Ltd.) to obtain a two-component developer 1.

Two-Component Developers 2 to 15 Production Example

Two-component developers 2 to 15 were obtained by carrying out the same procedure as in the Two-Component Developer 1 Production Example, but making the changes shown in Table 7.

TABLE 7

| | two-component developer | magnetic carrier | toner |
|---|---|---|---|
| Example 1 | 1 | 1 | 1 |
| Example 2 | 2 | 1 | 2 |
| Example 3 | 3 | 1 | 3 |
| Example 4 | 4 | 1 | 4 |
| Example 5 | 5 | 1 | 5 |
| Example 6 | 6 | 1 | 6 |
| Example 7 | 7 | 1 | 7 |
| Example 8 | 8 | 1 | 8 |
| Example 9 | 9 | 1 | 9 |
| Example 10 | 10 | 1 | 10 |
| Example 11 | 11 | 1 | 11 |
| Example 12 | 12 | 1 | 12 |
| Comparative Example 1 | 13 | 1 | 13 |
| Comparative Example 2 | 14 | 1 | 14 |
| Comparative Example 3 | 15 | 1 | 15 |

Example 1

Evaluations were performed using the two-component developer 1.

An imageRUNNER ADVANCE C9075 PRO, a printer from Canon, Inc. for digital commercial printing service, was used in a modified form for the image-forming apparatus. The two-component developer 1 was introduced into the developing device at the cyan position, and the evaluations described in the following were carried out by forming images at the desired toner laid-on level on the paper.

The machine was modified to enable the following to be freely settable: the fixation temperature, the process speed, the direct-current voltage $V_{DC}$ for the developer-carrying member, the charging voltage $V_D$ for the electrostatic latent image-bearing member, and the laser power.

FFh images (solid images) were output at the desired image ratio in image output evaluations. Here, FFh is a value where 256 gradations are represented as hexadecimal numbers, wherein 00h is the first gradation (white background area) of the 256 gradations and FFh is the 256th gradation (solid area) of the 256 gradations.

Evaluations were carried out based on the following evaluation methods, and their results are given in Table 8.

Low-Temperature Fixability paper: CS-680 (68.0 g/m$^2$)
(sold by Canon Marketing Japan Inc.)
toner laid-on level on the paper: 1.20 mg/cm$^2$
(adjusted using the direct-current voltage $V_{DC}$ for the developer-carrying member, the charging voltage $V_D$ for the electrostatic latent image-bearing member, and the laser power)
evaluation image: a 2 cm×5 cm image was placed in the center of the aforementioned A4 paper
fixing test environment: low-temperature, low-humidity environment: temperature of 15° C./humidity of 10% RH ("L/L" in the following)
fixation temperature: 150° C.
process speed: 450 mm/sec The evaluation image was output and the low-temperature fixability was evaluated. The value of the percentage decline in the image density was used as the index for evaluation of the low-temperature fixability.

For the percentage reduction in the image density, the image density in the center was first measured; an X-Rite color reflection densitometer (500 Series, X-Rite, Incorporated) is used for the measurement. Then, the fixed image in the area where the image density had been measured is rubbed (5 times back-and-forth) with lens-cleaning paper under a load of 4.9 kPa (50 g/cm$^2$) and the image density is measured again.

The percentage reduction in the image density pre-versus-post-rubbing was calculated using the following formula. The obtained percentage reduction in the image density was evaluated in accordance with the following evaluation criteria.

percentage reduction in image density=(pre-rubbing image density−post-rubbing image density)/pre-rubbing image density×100

(Evaluation Criteria)
A: the percentage reduction in image density is less than 5.0% (superior)
B: the percentage reduction in image density is at least 5.0% and less than 8.0% (excellent)
C: the percentage reduction in image density is at least 8.0% and less than 10.0% (good)
D: the percentage reduction in image density is at least 10.0% and less than 13.0% (unproblematic level)
E: the percentage reduction in image density is at least 13.0% (unacceptable)

Storability 5 g of the toner was introduced into a 100-mL plastic container; this was held for 48 hours in a thermostat that enabled the temperature and humidity to be changed (settings: 55° C., 41% RH); and the aggregation behavior of the toner was evaluated after the standing period.

The evaluation index for the aggregation behavior was the residual percentage for the toner that remained after shaking on a mesh with an aperture of 20 μm for 10 seconds at an amplitude of 0.5 mm using a Powder Tester PT-X from Hosokawa Micron Corporation.
(Evaluation Criteria)
A: the residual percentage is less than 2.0% (superior)
B: the residual percentage is at least 2.0% and less than 5.0% (excellent)
C: the residual percentage is at least 5.0% and less than 7.5% (good)

D: the residual percentage is at least 7.5% and less than 10.0% (unproblematic level)

E: the residual percentage is at least 10.0% (unacceptable)

Charge Retention Performance in High-Temperature, High-Humidity Environments

The triboelectric charge quantity for the toner and the toner laid-on level were determined by suction collection, using a metal cylindrical tube and a cylindrical filter, of the toner on the electrostatic latent image-bearing member.

Specifically, the triboelectric charge quantity and the toner laid-on level for the toner on the electrostatic latent image-bearing member were measured using a Faraday cage.

A Faraday cage is a coaxial double cylinder wherein the inner cylinder is insulated from the outer cylinder. When a charged body carrying a charge quantity Q is introduced into this inner cylinder, due to electrostatic induction this is the same as the presence of a metal cylinder carrying charge quantity Q. This induced charge quantity was measured with an electrometer (Keithley 6517A, Keithley Instruments, Inc.), and the charge quantity Q (mC) divided by the mass M (kg) of the toner in the inner cylinder, or Q/M, was taken to be the triboelectric charge quantity for the toner.

In addition, the toner laid-on level per unit area was obtained by measuring the suctioned area S and dividing the toner mass M by the suctioned area S ($cm^2$).

The toner was measured by stopping the rotation of the electrostatic latent image-bearing member prior to transfer, to the intermediate transfer member, of the toner layer formed on the electrostatic latent image-bearing member and directly air-suctioning the toner image on the electrostatic latent image-bearing member.

toner laid-on level ($mg/cm^2$)=M/S toner triboelectric charge quantity (mC/kg)=Q/M paper: CS-680 (68.0 $g/m^2$)

(sold by Canon Marketing Japan Inc.)

toner laid-on level on the paper: 0.35 $mg/cm^2$ (FFh image)

test environment: high-temperature, high-humidity environment (temperature of 30° C./humidity of 80% RH (H/H in the following))

Using the image-forming apparatus described above, 10,000 prints were output onto the aforementioned A4 paper of an FFh output strip chart having an image ratio of 0.1%. After this, a solid image (FFH) was formed on the electrostatic latent image-bearing member; the rotation of the electrostatic latent image-bearing member was stopped prior to transfer to the intermediate transfer member; and the toner on the electrostatic latent image-bearing member was suctioned off and collected using the metal cylindrical tube and cylindrical filter.

At this time, the charge quantity Q that went into the metal cylindrical tube and was accumulated in a capacitor and the collected toner mass M were measured, and the charge quantity per unit mass Q/M (mC/kg) was calculated and used for the initial charge quantity per unit mass Q/M (mC/kg) on the electrostatic latent image-bearing member.

The developing device inserted in the evaluation machine was then held as such for 2 weeks in the H/H environment, after which the same procedure as before the holding period was carried out in order to measure the post-holding charge quantity per unit mass Q/M (mC/kg) on the electrostatic latent image-bearing member. Using the aforementioned initial Q/M per unit mass on the electrostatic latent image-bearing member for 100%, the retention ratio for the post-holding Q/M per unit mass on the electrostatic latent image-bearing member ([post-holding Q/M]/[initial Q/M]×100) was calculated and was scored using the following criteria.

(Evaluation Criteria)

A: the retention ratio is at least 90% (excellent)

B: the retention ratio is at least 85% and less than 90% (good)

C: the retention ratio is at least 80% and less than 85% (unproblematic level)

D: the retention ratio is less than 80% (unacceptable)

Examples 2 to 12 and Comparative Examples 1 to 3

Evaluations were carried out proceeding in the same manner as in Example 1, but using the two-component developers 2 to 15. The results of the evaluations are shown in Table 8.

In Example 2, the heat-treatment step is not performed and quenching is not carried out and the compatibility between the amorphous resin and crystalline resin is reduced, and due to this the low-temperature fixability is inferior to that in Example 1. In addition, there is less transfer of the release agent to near the vicinity of the toner surface and the hydrophobicity of the toner surface is then lower, and due to this the storability and charge retention performance are also inferior to those in Example 1.

In Example 3, highly hydrophobic cyclohexyl methacrylate is not incorporated in the composition for the graft polymer, and as a result the hydrophobicity of the toner is lowered and the storability and charge retention performance are inferior to those in Example 2.

In Example 4, the crystalline resin has a larger SP(C) and the compatibility between the amorphous resin and crystalline resin is higher and the storability is then inferior to that in Example 3.

In Example 5, the crystalline resin has a smaller SP(C) and the compatibility between the amorphous resin and crystalline resin is lowered and the low-temperature fixability is then inferior to that in Example 3.

In Example 6, the crystalline resin has a large SP(C) and the compatibility between the amorphous resin and crystalline resin is increased and the storability is then inferior to that in Example 4.

In Example 7, the crystalline resin has a small SP(C) and the compatibility between the amorphous resin and crystalline resin is lowered and the low-temperature fixability is then inferior to that in Example 5.

In Example 8, while the amorphous resin has a smaller SP(A), the amorphous resin has a larger peak molecular weight and the compatibility between the amorphous resin and crystalline resin is lowered and due to this the low-temperature fixability is inferior to that in Example 7.

In Example 9, while the amorphous resin has a smaller peak molecular weight, its SP(A) is larger and the compatibility between the amorphous resin and crystalline resin is lowered and due to this the low-temperature fixability is inferior to that in Example 7.

In Example 10, the amorphous resin has a larger peak molecular weight and the compatibility between the amorphous resin and crystalline resin is lowered and due to this the low-temperature fixability is inferior to that in Example 8.

In Example 11, the amorphous resin has a smaller peak molecular weight and the compatibility between the amorphous resin and crystalline resin is increased and recrystallization of the crystalline resin is then inhibited, and due to this the storability is inferior to that in Example 9.

In Example 12, the amorphous resin has a larger SP(A) and peak molecular weight and the compatibility between the amorphous resin and crystalline resin is lowered and due to this the low-temperature fixability is inferior to that in Example 9.

In Comparative Example 1, the amorphous resin has a smaller SP (A) and a very large peak molecular weight and the compatibility between the amorphous resin and crystalline resin is lowered and due to this the low-temperature fixability is much inferior to that in Example 9.

In Comparative Example 2, the amorphous resin has a very large SP(A) and a very small peak molecular weight and recrystallization of the crystalline resin is inhibited and due to this the storability and charge retention performance are much inferior to those in Example 9.

In Comparative Example 3, the amorphous resin has a large SP(A) and a large peak molecular weight and the compatibility between the amorphous resin and crystalline resin is lowered and due to this the low-temperature fixability is much inferior to that in Example 9.

TABLE 8

| | storability [%] | | low-temperature fixability [%] | | | charge retention performance [%] | | |
|---|---|---|---|---|---|---|---|---|
| Example 1 | A | 1.0 | A | 1.45⇒1.40 | 3.4 | A | 35⇒33 | 94 |
| Example 2 | A | 1.5 | B | 1.45⇒1.37 | 5.5 | B | 35⇒31 | 89 |
| Example 3 | B | 3.9 | B | 1.45⇒1.35 | 6.9 | C | 35⇒29 | 83 |
| Example 4 | B | 4.7 | B | 1.45⇒1.36 | 6.2 | C | 35⇒29 | 83 |
| Example 5 | B | 3.1 | B | 1.45⇒1.34 | 7.6 | C | 35⇒29 | 83 |
| Example 6 | C | 5.1 | B | 1.45⇒1.37 | 5.5 | C | 35⇒29 | 83 |
| Example 7 | B | 3.5 | C | 1.45⇒1.33 | 8.3 | C | 35⇒29 | 83 |
| Example 8 | B | 3.3 | C | 1.45⇒1.32 | 9.0 | C | 35⇒29 | 83 |
| Example 9 | B | 3.3 | C | 1.45⇒1.32 | 9.0 | C | 35⇒29 | 83 |
| Example 10 | B | 2.9 | D | 1.45⇒1.30 | 10.3 | C | 35⇒29 | 83 |
| Example 11 | D | 7.5 | C | 1.45⇒1.33 | 8.3 | C | 35⇒29 | 83 |
| Example 12 | B | 2.6 | D | 1.45⇒1.27 | 12.4 | C | 35⇒29 | 83 |
| Comparative Example 1 | B | 2.6 | E | 1.45⇒1.25 | 13.8 | B | 35⇒30 | 86 |
| Comparative Example 2 | E | 10.2 | B | 1.45⇒1.35 | 6.9 | D | 35⇒27 | 77 |
| Comparative Example 3 | B | 2.5 | E | 1.45⇒1.23 | 15.2 | B | 35⇒31 | 89 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-164509, filed Aug. 25, 2016, which is hereby incorporated by reference herein in its entirety.

What is claimed is:

1. A toner comprising: a toner particle containing:

an amorphous resin, a crystalline resin, a colorant, a release agent, and a polymer in which a styrene-acrylic polymer is graft-polymerized on a polyolefin, wherein the amorphous resin contains an amorphous polyester resin A, and the amorphous polyester resin A (1) has a monomer unit derived from polyhydric alcohol and a monomer unit derived from polyhydric carboxylic acid, has a content, in the monomer unit derived from polyhydric carboxylic acid, of at least 20.0 mol % and not more than 60.0 mol % of a succinic acid-derived monomer unit, and has a content, in the monomer unit derived from polyhydric alcohol, of at least 90.0 mol % and not more than 100.0 mol % of a monomer unit derived from a propylene oxide adduct on bisphenol A, (2) has a softening point of at least 85° C. and not more than 95° C., (3) has a solubility parameter [SP(A)], determined based on Fedors' equation, of at least 12.30 and not more than 12.40, and (4) has a peak molecular weight [Mp(A)] of at least 4,000 and not more than 5,000.

2. The toner according to claim 1, wherein the crystalline resin comprises a crystalline polyester resin C, and the crystalline polyester resin C has a solubility parameter [SP(C)], determined based on Fedors' equation, of at least 11.00 and not more than 11.40.

3. The toner according to claim 1, wherein the styrene-acrylic polymer comprises a monomer unit derived from a cycloalkyl (meth)acrylate.

* * * * *